US011466556B2

(12) United States Patent
Hopwood et al.

(10) Patent No.: US 11,466,556 B2
(45) Date of Patent: Oct. 11, 2022

(54) STALL DETECTION AND RECOVERY FOR MUD MOTORS

(71) Applicant: Helmerich & Payne, Inc., Tulsa, OK (US)

(72) Inventors: Fergus Hopwood, Whitefish, MT (US); Christopher Robert Novosad, Bixby, OK (US)

(73) Assignee: HELMERICH & PAYNE, INC., Tulsa, OK (US)

( * ) Notice: Subject to any disclaimer, the term of this patent is extended or adjusted under 35 U.S.C. 154(b) by 0 days.

(21) Appl. No.: 16/415,505

(22) Filed: May 17, 2019

(65) Prior Publication Data

US 2020/0362687 A1 Nov. 19, 2020

(51) Int. Cl.

| | |
|---|---|
| ***E21B 44/02*** | (2006.01) |
| ***E21B 4/02*** | (2006.01) |
| ***E21B 7/04*** | (2006.01) |
| ***E21B 21/10*** | (2006.01) |
| ***E21B 44/00*** | (2006.01) |
| ***E21B 21/08*** | (2006.01) |
| ***E21B 3/00*** | (2006.01) |

(52) U.S. Cl.

CPC ..... *E21B 44/02* (2013.01); *E21B 4/02* (2013.01); *E21B 7/046* (2013.01); *E21B 21/08* (2013.01); *E21B 21/103* (2013.01); *E21B 44/00* (2013.01); *E21B 3/00* (2013.01)

(58) Field of Classification Search

CPC . E21B 44/02; E21B 4/02; E21B 7/046; E21B 21/103; E21B 3/00; E21B 21/08; E21B 44/00

See application file for complete search history.

(56) References Cited

U.S. PATENT DOCUMENTS

| | | | |
|---|---|---|---|
| 1,011,985 | A | 12/1911 | Mickelsen |
| 1,013,871 | A | 1/1912 | Ellis et al. |
| 2,742,265 | A | 4/1956 | Snyder |
| 4,676,310 | A | 6/1987 | Scherbatskoy et al. |

(Continued)

FOREIGN PATENT DOCUMENTS

| | | | |
|---|---|---|---|
| GB | 2236782 | A | 4/1991 |
| WO | 2009039448 | A2 | 3/2009 |

(Continued)

OTHER PUBLICATIONS

Duplantis, Steven, "Slide Drilling-Farther and Faster," Oilfield Review; May 2016; p. 50-56.

(Continued)

*Primary Examiner* — Nicole Coy

(74) *Attorney, Agent, or Firm* — Kilpatrick Townsend & Stockton LLP

(57) ABSTRACT

A system and method for stall recovery of mud motors may be implemented in a steering control system. The stall recovery system and method may involve automatic detection of a stall of a mud motor during drilling controlled by the steering control system, and may respond to the stall in a rapid and controlled manner to avoid or minimize damage to the mud motor, such as by immediately reducing mud pressure and stopping rotary drilling, if used, faster than a typical human operator could perform. The stall recovery system and method may farther take actions to automatically restart drilling.

33 Claims, 12 Drawing Sheets

(56) References Cited

U.S. PATENT DOCUMENTS 4,794,534 A 12/1988 Millheim
5,193,628 A 3/1993 Hill, III et al.
5,220,963 A 6/1993 Patton
5,812,068 A 9/1998 Wisler et al.
5,857,531 A 1/1999 Estep et al.
6,088,294 A 7/2000 Leggett, III et al.
6,233,524 B1 5/2001 Harrell et al.
6,257,356 B1 7/2001 Wassell
6,272,434 B1 8/2001 Wisler et al.
6,279,702 B1 8/2001 Koh
6,408,953 B1 6/2002 Goldman et al.
6,424,919 B1 7/2002 Moran et al.
6,470,977 B1 10/2002 Chen et al.
6,523,623 B1 2/2003 Schuh
6,577,954 B2 6/2003 Alft et al.
6,581,699 B1 6/2003 Chen et al.
6,601,658 B1 8/2003 Downton
6,612,382 B2 9/2003 King
6,732,052 B2 5/2004 Macdonald et al.
6,968,909 B2 11/2005 Aldred et al.
7,000,710 B1 2/2006 Umbach
7,003,439 B2 2/2006 Aldred et al.
7,011,156 B2 3/2006 Von Gynz-Rekowski
7,032,689 B2 4/2006 Goldman et al.
7,054,750 B2 5/2006 Rodney et al.
7,073,582 B2 7/2006 Connell et al.
7,085,696 B2 8/2006 King
7,136,795 B2 11/2006 Downton
7,142,986 B2 11/2006 Moran
7,191,850 B2 3/2007 Williams
7,342,504 B2 3/2008 Crane et al.
7,357,196 B2 4/2008 Goldman et al.
7,359,844 B2 4/2008 Sung et al.
7,460,957 B2 12/2008 Prange et al.
7,546,209 B2 6/2009 Williams
7,606,666 B2 10/2009 Repin et al.
7,650,241 B2 1/2010 Jogi et al.
7,653,563 B2 1/2010 Veeningen et al.
7,684,929 B2 3/2010 Prange et al.
7,725,263 B2 5/2010 Sugiura
7,802,634 B2 9/2010 Boone
7,823,655 B2 11/2010 Boone et al.
7,860,593 B2 12/2010 Boone
7,861,800 B2 1/2011 Chapman et al.
7,873,476 B2 1/2011 Thorne
7,938,197 B2 5/2011 Boone et al.
7,945,488 B2 5/2011 Karr et al.
7,957,946 B2 6/2011 Pirovolou
8,010,290 B2 8/2011 Illfelder
8,061,440 B2 11/2011 Chapman et al.
8,261,856 B1 9/2012 Stacy, II et al.
8,274,399 B2 9/2012 Strachan et al.
8,278,931 B2 10/2012 Fang et al.
8,360,171 B2 1/2013 Boone et al.
8,463,549 B1 6/2013 Selman et al.
8,463,550 B1 6/2013 Selman et al.
8,489,375 B2 7/2013 Omeragic et al.
8,510,081 B2 8/2013 Boone et al.
8,528,663 B2 9/2013 Boone
8,577,660 B2 11/2013 Wendt et al.
8,614,713 B1 12/2013 Selman et al.
8,615,363 B2 12/2013 Aamodt et al.
8,686,996 B2 4/2014 Cheung et al.
8,768,627 B2 7/2014 Paulk
8,818,779 B2 8/2014 Sadlier et al.
8,875,806 B2 11/2014 Williams
8,939,233 B2 1/2015 Edbury et al.
8,960,326 B2 2/2015 Williams
8,965,703 B2 2/2015 Prakash et al.
9,022,140 B2 5/2015 Marx et al.
9,041,547 B2 5/2015 Hartmann
9,091,140 B1 7/2015 Selman et al.
9,097,096 B1 8/2015 Selman et al.
9,103,192 B2 8/2015 Yang
9,182,517 B1 11/2015 Selman et al.
9,223,041 B2 12/2015 Wendt et al.
9,238,960 B2 1/2016 Benson et al.
9,267,341 B2 * 2/2016 Reddy ..... E21B 3/02
9,322,261 B2 4/2016 Selman et al.
9,334,723 B2 5/2016 Yang
9,349,212 B2 5/2016 Cheung et al.
9,528,366 B2 12/2016 Selman et al.
9,528,367 B2 12/2016 Selman et al.
9,528,372 B2 12/2016 Selman et al.
9,549,854 B1 1/2017 Crespo
9,556,728 B2 1/2017 De Reynal, Jr.
9,598,949 B1 3/2017 Selman et al.
9,599,742 B1 3/2017 Selman et al.
9,702,240 B2 7/2017 Bittar et al.
9,720,131 B2 8/2017 Zhuo et al.
9,879,490 B2 * 1/2018 Edbury ..... E21B 44/00
10,036,678 B2 7/2018 Fisher, Jr. et al.
10,119,385 B2 11/2018 Williams
10,138,721 B2 11/2018 Veltman
10,151,192 B2 12/2018 Burress et al.
10,215,010 B1 2/2019 Hadi et al.
10,378,329 B2 * 8/2019 Boone ..... E21B 7/022
10,533,409 B2 1/2020 Benson et al.
10,584,574 B2 3/2020 Benson et al.
10,672,154 B2 6/2020 Gillen et al.
2001/0042642 A1 11/2001 King
2001/0054514 A1 12/2001 Sullivan et al.
2002/0070050 A1 6/2002 Wassell
2002/0103630 A1 8/2002 Aldred et al.
2002/0139581 A1 10/2002 Schultz et al.
2003/0024738 A1 2/2003 Schuh
2004/0168811 A1 9/2004 Shaw et al.
2005/0006145 A1 1/2005 Downton
2005/0150689 A1 7/2005 Jogi et al.
2005/0194130 A1 9/2005 Best et al.
2005/0194185 A1 9/2005 Gleitman
2005/0269082 A1 12/2005 Baron et al.
2006/0074561 A1 4/2006 Xia et al.
2006/0151214 A1 7/2006 Prange et al.
2007/0163810 A1 7/2007 Underwood et al.
2007/0221375 A1 9/2007 Baron et al.
2008/0172272 A1 7/2008 Back et al.
2008/0230272 A1 9/2008 Chen et al.
2008/0271925 A1 11/2008 Misselbrook et al.
2009/0000823 A1 1/2009 Pirovolou
2009/0076873 A1 3/2009 Johnson et al.
2009/0090555 A1 4/2009 Boone et al.
2009/0120690 A1 5/2009 Phillips
2010/0139977 A1 6/2010 Watkins et al.
2010/0175922 A1 7/2010 Ignova et al.
2010/0191516 A1 7/2010 Benish et al.
2010/0252327 A1 10/2010 Beuershausen et al.
2010/0259415 A1 10/2010 Strachan et al.
2011/0024191 A1 2/2011 Boone
2011/0067928 A1 3/2011 Hulden et al.
2011/0153300 A1 6/2011 Holl et al.
2011/0186353 A1 8/2011 Turner et al.
2011/0213601 A1 9/2011 Pirovolou
2012/0024606 A1 2/2012 Pirovolou et al.
2012/0027516 A1 2/2012 Day et al.
2012/0048621 A1 3/2012 Stewart et al.
2012/0285701 A1 11/2012 Cheng et al.
2013/0032401 A1 2/2013 Edbury et al.
2013/0032402 A1 2/2013 Byreddy et al.
2013/0092441 A1 4/2013 Hummes et al.
2013/0112484 A1 5/2013 Chen
2013/0126239 A1 5/2013 Panchal et al.
2013/0140037 A1 6/2013 Sequeira, Jr. et al.
2013/0161096 A1 6/2013 Benson et al.
2013/0238306 A1 9/2013 Lagenwalter et al.
2013/0262048 A1 10/2013 Tang et al.
2013/0340999 A1 12/2013 Benson
2015/0107899 A1 4/2015 Fisher, Jr. et al.
2015/0218914 A1 8/2015 Marx et al.
2015/0267525 A1 9/2015 May et al.
2016/0076357 A1 3/2016 Hbaieb
2016/0370480 A1 12/2016 Shetty et al.
2017/0037722 A1 2/2017 Jeffryes et al.
2017/0152739 A1 6/2017 Benson et al.

(56) References Cited

U.S. PATENT DOCUMENTS

| | | | | |
|---|---|---|---|---|
| 2017/0183952 | A1 | 6/2017 | Williams | |
| 2018/0003839 | A1 | 1/2018 | Lowell et al. | |
| 2018/0068037 | A1 | 3/2018 | Williams | |
| 2018/0073351 | A9 | 3/2018 | Benson et al. | |
| 2018/0135402 | A1* | 5/2018 | Jeffryes | E21B 4/02 |
| 2018/0171773 | A1 | 6/2018 | Nessjoen et al. | |
| 2018/0179823 | A1 | 6/2018 | Spatz et al. | |
| 2018/0179831 | A1 | 6/2018 | Spatz et al. | |
| 2018/0258750 | A1 | 9/2018 | Hadi et al. | |
| 2018/0283156 | A1 | 10/2018 | Viens | |
| 2018/0283157 | A1 | 10/2018 | Hadi et al. | |
| 2018/0340406 | A1 | 11/2018 | Wagner et al. | |
| 2018/0340407 | A1 | 11/2018 | Wagner et al. | |
| 2018/0343040 | A1 | 11/2018 | Luzinski et al. | |
| 2018/0371889 | A1 | 12/2018 | Hohl et al. | |
| 2019/0040697 | A1* | 2/2019 | Barker | E21B 21/10 |
| 2019/0048706 | A1 | 2/2019 | Benson et al. | |
| 2019/0048707 | A1 | 2/2019 | Benson et al. | |
| 2019/0120013 | A1* | 4/2019 | Gay | E21B 34/08 |
| 2019/0323335 | A1* | 10/2019 | Ocegueda-Hernandez | E21B 4/02 |
| 2020/0095836 | A1* | 3/2020 | Palmer | E21B 34/10 |

FOREIGN PATENT DOCUMENTS

| | | | |
|---|---|---|---|
| WO | 2016102381 | A1 | 6/2016 |
| WO | 2018144169 | A1 | 8/2018 |
| WO | 2018152636 | A1 | 8/2018 |

OTHER PUBLICATIONS

Cougar Drilling Solutions "Motor Operations Handbook," Version 5.0; 2012.
"Cougar DS Motor Operations", Cougar Drilling Solutions, 1 page.
"Dictionary, Encyclopedia and Thesaurus—The Free Dictionary", Available Online at: https://www.thefreedictionary.com/, Accessed from Internet on Oct. 1, 2020, 6 pages.
"Drilling Performance Daily Report", Paloma Operating, H&P 493, Oct. 3, 2019, 6 pages.
"Jagged Peak Motor Stall Procedure", 1 page.
"Motor Operations Handbook", Cougar Drilling Solution, Cougar DS Motor Operations, Version 5.0, 2012, 179 pages.
"Motor Stall Detection", Pason, EDR 19.7, 1 page.
"SLB Mud Motor Stall Procedure", Schlumberger, 1 page.
"Stalled Motor Protocol", Pioneer Natural Resouices, 4 pages.
"The Oilfield Glossary—Schlumberger Oilfield Glossary", Available Online at https://www.glossary.oilfield.slb.com/, Accessed from Internet on Oct. 1, 2020, 1 page.
"What is a Mud Motor Stall?", Apache, Dec. 2018, 4 pages.
U.S. Appl. No. 16/101,161, "Non-Final Office Action", dated Mar. 5, 2019, 19 pages.
U.S. Appl. No. 16/101,161, "Notice of Allowance", dated Oct. 10, 2019, 7 pages.
U.S. Appl. No. 16/132,256, "Final Office Action", dated Jul. 11, 2019, 18 pages.
U.S. Appl. No. 16/132,256, "Non-Final Office Action", dated Dec. 31, 2018, 14 pages.
U.S. Appl. No. 16/132,256, "Notice of Allowance", dated Aug. 26, 2019, 6 pages.
U.S. Appl. No. 16/591,387, "Notice of Allowance", dated Jul. 1, 2020, 8 pages.
U.S. Appl. No. 16/774,528, "Non-Final Office Action", dated Jun. 25, 2020, 11 pages.
U.S. Appl. No. 16/774,528, "Notice of Allowance", dated Nov. 12, 2020, 5 pages.
U.S. Appl. No. 16/774,528, "Notice of Allowance", dated Oct. 5, 2020, 5 pages.
Duplantis, et al., "Slide Drilling—Farther and Faster", Oilfield Review, vol. 28, No. 2, May 2016, pp. 50-56.
Pastusek, et al., "A Fundamental Model for Prediction of Hole Curvature and Build Rates With Steerable Bollomhole Assemblies", Society of Petroleum Engineers, SPE Annual Technical Conference and Exhibit, 2005, 7 pages.
PCT/US2013/047054, "International Preliminary Report on Patentability", dated Dec. 31, 2014, 10 pages.
PCT/US2013/047054, "International Search Report and Written Opinion", dated Jun. 25, 2014, 12 pages.
Saputelli, et al., "Real-Time Decision-Making for Value Creation While Drilling", SPE/IADC Middle East Drilling Technology Conference and Exhibition, Oct. 22-23, 2003, pp. 1-19.

* cited by examiner

STALL DETECTION AND RECOVERY FOR MUD MOTORS

BACKGROUND

Field of the Disclosure

The present disclosure provides systems and methods useful for stall recovery for mud motors, including automated stall detection and recovery systems and methods. The systems and methods disclosed herein can be computer-implemented using processor executable instructions for execution on a processor and can accordingly be executed with a programmed computer system.

Description of the Related Art

Drilling a borehole for the extraction of minerals has become an increasingly complicated operation due to the increased depth and complexity of many boreholes, including the complexity added by directional drilling, Drilling is an expensive operation and errors in drilling add to the cost and, in some cases, drilling errors may permanently lower the output of a well for years into the future. Conventional technologies and methods may not adequately address the complicated nature of drilling, and may not be capable of gathering and processing various information from downhole sensors and surface control systems in a timely manner, in order to improve drilling operations and minimize drilling errors.

In particular, when drilling using a mud motor, various issues can cause the mud motor to stall or become stuck, instead of rotating normally within an acceptable operating range. When the mud motor stalls, various delays or operator errors while responding to the stall may tail to prevent damage to the mud motor or other equipment, which is undesirable during drilling.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
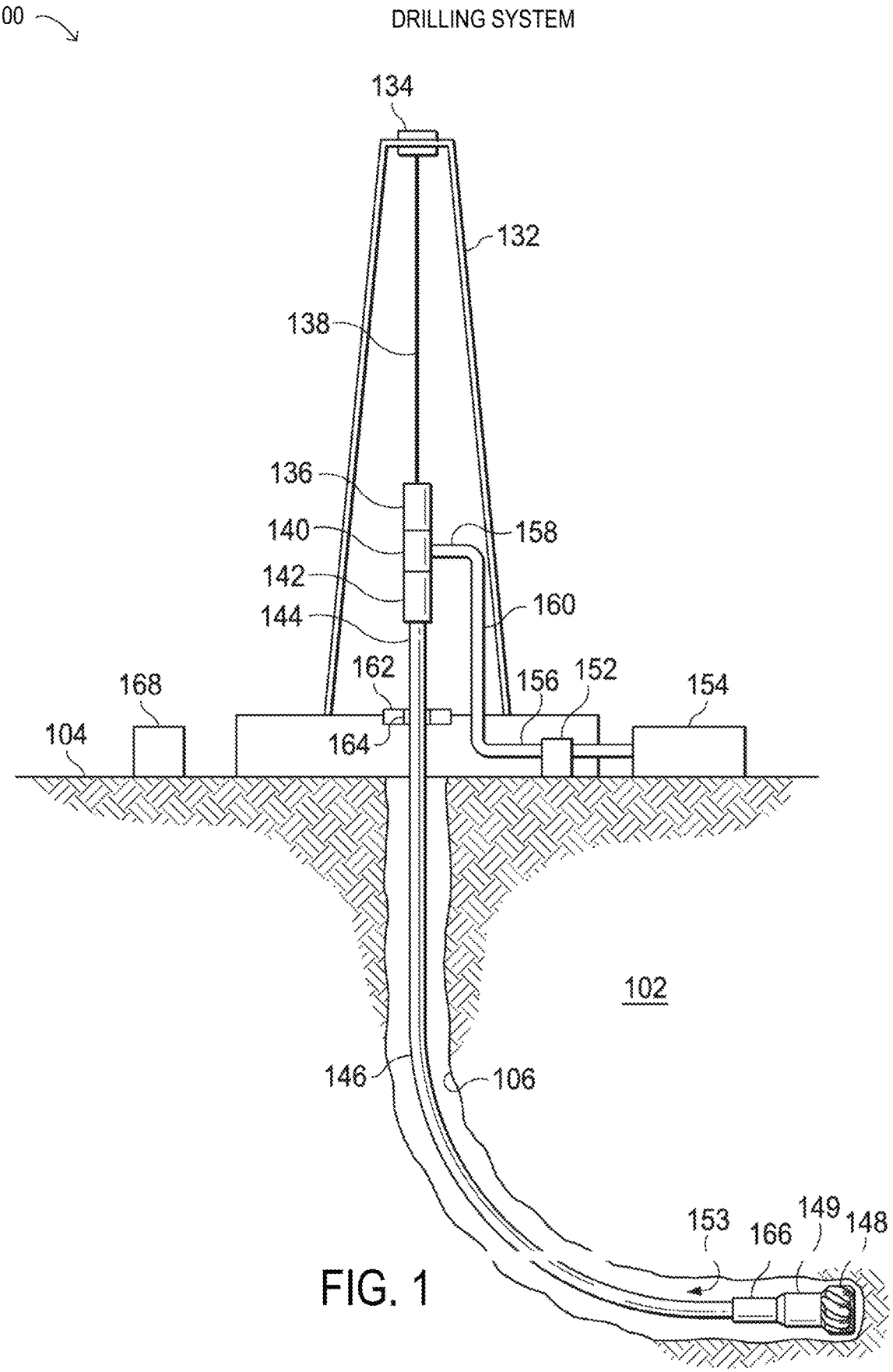
FIG. 1 is a depiction of a drilling system for drilling a borehole.

In the following description, details are set forth by way of example to facilitate discussion of the disclosed subject matter. It is noted, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drilling plan, and how to handle issues that arise during drilling. However, even the best geologists and drilling engineers perform some guesswork due to the unique nature, of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve desirable drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes, because drilling errors can add significant cost to drilling operations. In some cases, drilling errors may permanently lower the output of a well, resulting in substantial long term economic losses due to the lost output of the well.

Therefore, the well plan may be updated based on new stratigraphic information from the wellbore, as it is being drilled. This stratigraphic information can be gained on one hand from Measurement While Drilling (MWD) and Logging While Drilling, (LWD) sensor data, but could also include other reference well data, such as drilling dynamics data or sensor data giving information, for example, on the hardness of the rock in individual strata layers being drilled through.

A method for updating the well plan with additional stratigraphic data may first combine the various parameters into a single characteristic function, both for the subject well and every offset well. For every pair of subject well and offset: well, a heat map can be computed to display the misfit between the characteristic functions of the subject and offset wells. The heat maps may then enable the identification of paths (x(MD), y(MD)), parameterized by the measured depth (MD) along the subject well. These paths uniquely describe the vertical depth of the subject well relative to the geology (e.g., formation) at every offset well. Alternatively, the characteristic functions of the offset wells can be combined into a single characteristic function at the location of the subject wellbore. This combined characteristic function changes along the subject well with changes in the stratigraphy. The heat map may also be used to identify stratigraphic anomalies, such as structural faults, stringers and breccia. The identified paths may be used in updating the well plan with the latest data to steer the wellbore into the geological target(s) and keep the wellbore in the target zone.

Referring now to the drawings, Referring to FIG. 1, a drilling system 100 is illustrated in one embodiment as a top drive system. As Shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture 153 (e.g., a mud mixture) from a mud pit 154 into drill string 146. Mud pit 154 is shown schematically as a container, but it is noted that various receptacles, tanks, pits, or other containers may be used. Mud 153 may flow from mud pump 152 into a discharge line 156 that is coupled to a rotary hose 158 by a standpipe 160. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BRA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) took for acquiring information, such as toolfsace and formation logging information, that may be saved for later retrieval, transmitted with or without a delay using any of various communication means wireless, wireline, or mud pulse telemetry), or otherwise transferred to steering control system 168. As used herein, an MWD tool is enabled to communicate downhole measurements without substantial delay to the surface 104, such as using mud puke telemetry, while a LWD tool is equipped with an internal memory that stores measurements when downhole and can be used to download a stored log of measurements when the LWD tool is at the surface 104, The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system. 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system. 168 may be accessible via a communication network (see also FIG. 10), and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system. 168 may be located in downhole tool 166 (not shown). In some embodiments, steering control system 168 may communicate with a separate controller (not shown) located in downhole tool 166. In particular, steering control system 168 may receive and process measurements received from downhole surveys, and may perform the calculations described herein for surface steering using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BRA 149, that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system. 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling, process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole tool face/inclination information, downhole tool gamma/resistivity information, economic parameters, reliability parameters, among various other parameters. Some of the input information, such as the regional formation history, may be available from a drilling hub 410, Which may have respective access to a regional drilling database (DB) 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling, rig, in order to achieve the desired results, which are indicated in the feedback information. The output information generated by steering control system 168 may include indications to modify one or more drilling parameters, the direction of drilling, the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 2:
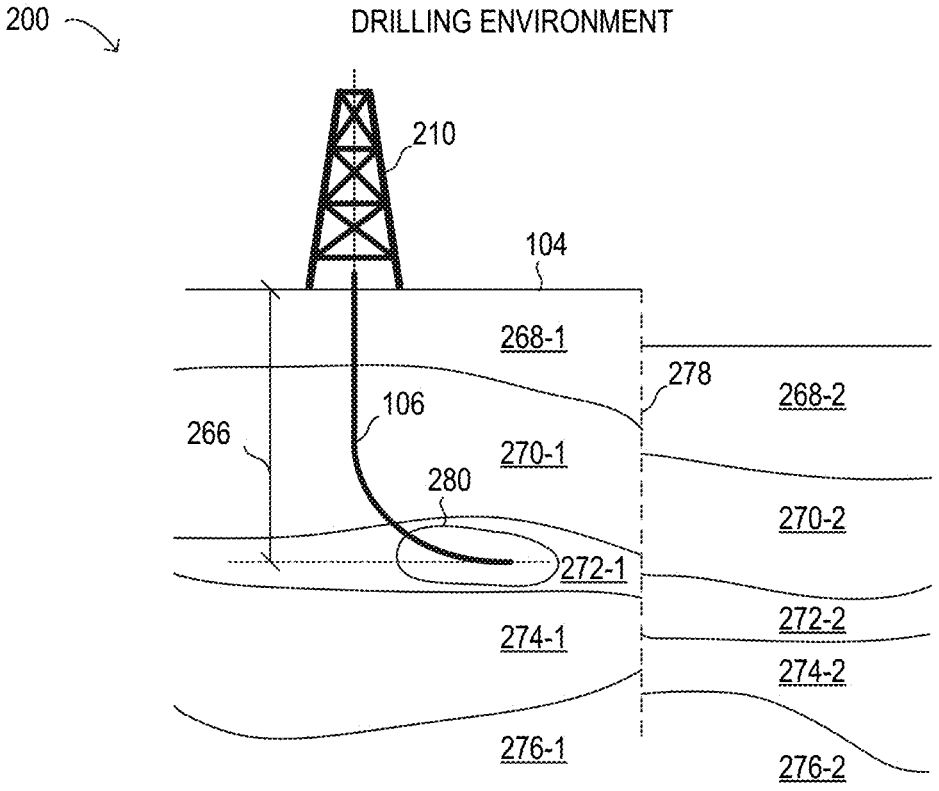
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drilling plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 2764. A target area 280 specified in the drilling plan may be located in strata layer 272-1 as shown in FIG. 2. Target area 280 may represent a desired endpoint of borehole 106, such as a hydrocarbon producing area indicated by strata layer 2724. It is noted that target area 280 may be of any shape and size, and may be defined using various different methods and information in different embodiments. In some instances, target area 280 may be specified in the drilling plan using subsurface coordinates, or references to certain markers, that indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106, but may involve staying within a strata layer that varies in depth and thickness as illustrated by strata layer 172. As such, directional drilling may involve multiple vertical adjustments that complicate the trajectory of borehole 106.

Figure 3:
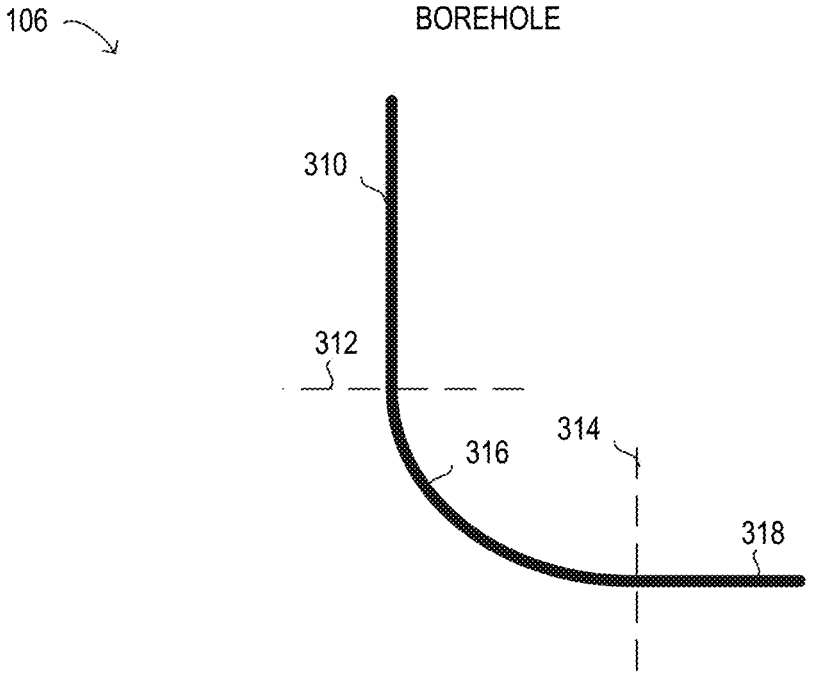
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition front vertical to horizontal, a curve may be defined that specifics a so-called "build up" section 316. Build up section 316 may begin at a kick off point 312 in vertical portion 310 and may end at a begin point 314 of horizontal portion 318. The change in inclination in build up section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive build rate can cause problems such as severe doglegs (e.g., sharp changes in direction in the borehole) that may make it difficult or impossible to run easing or perform other operations in borehole 106. Depending on the severity of any mistakes made during directional drilling, borehole 106 may be enlarged or drill bit 146 may be backed out of a portion of borehole 106 and redrilled along a different path. Such mistakes may be undesirable due to the additional time and expense involved. However, if the build rate is too cautious, additional overall time may be added to the drilling process, because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding", are commonly used to form borehole 106. Rotating, also called "rotary drilling", uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in build up section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a tool face is confirmed that indicates a direction of the bend of the mud motor is oriented to a direction of a desired deviation (i.e., build rate) of borehole 106, Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
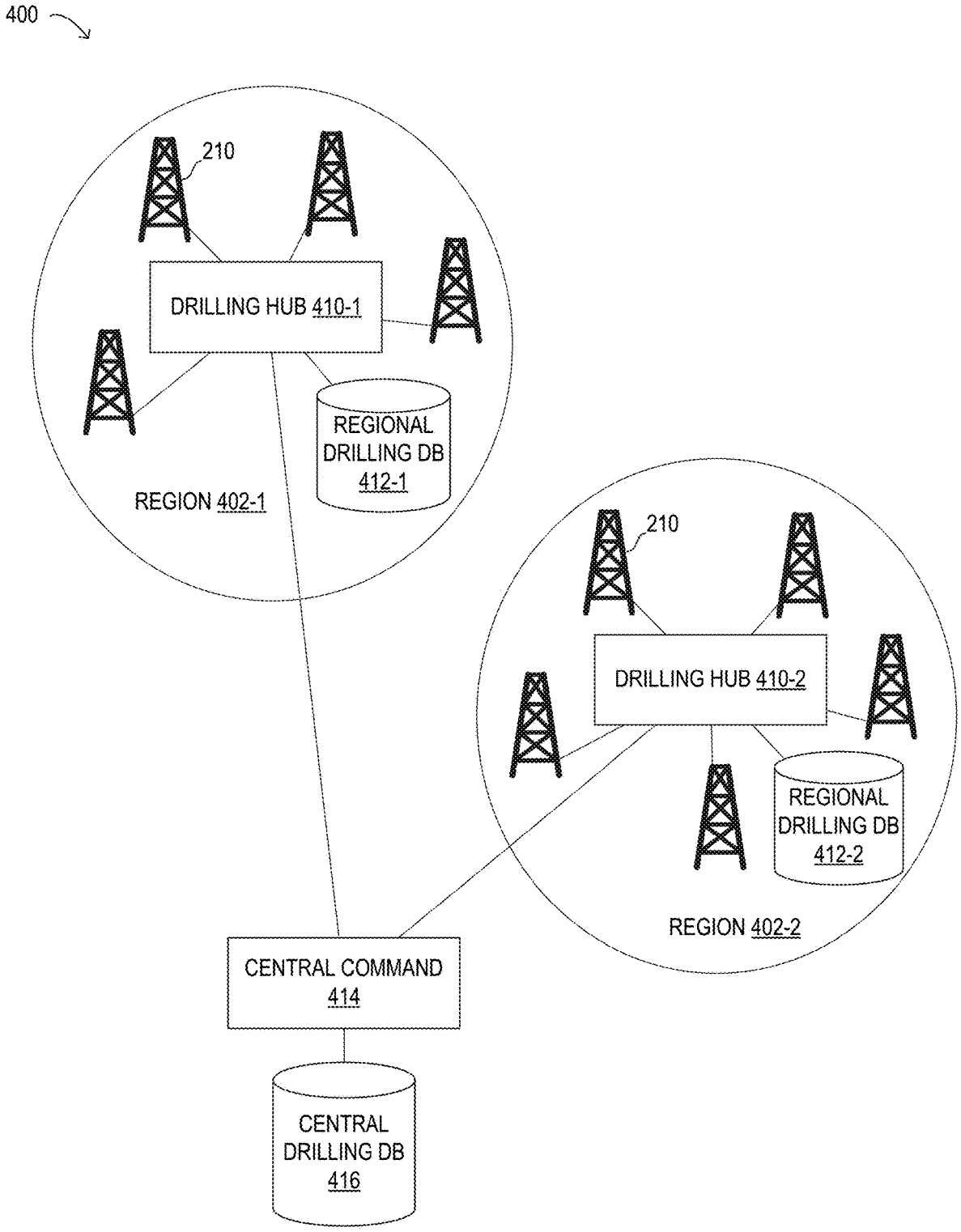
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering, control system 168 that is enabled to perform various drilling control operations locally to drilling rig 210. When steering control system 168 is enabled with network connectivity, certain control operations or processing may be requested or queried by steering control system 168 from a remote processing resource. As Shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region. 402, and may be in different stages of drilling through the depths of formation strata layers at region 402. Thus, for any given well being drilled by drilling rig 210 in a region. 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412, or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drilling plan for drilling rig 210 may include processing and analyzing the collected data in regional drilling DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, Or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may, be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
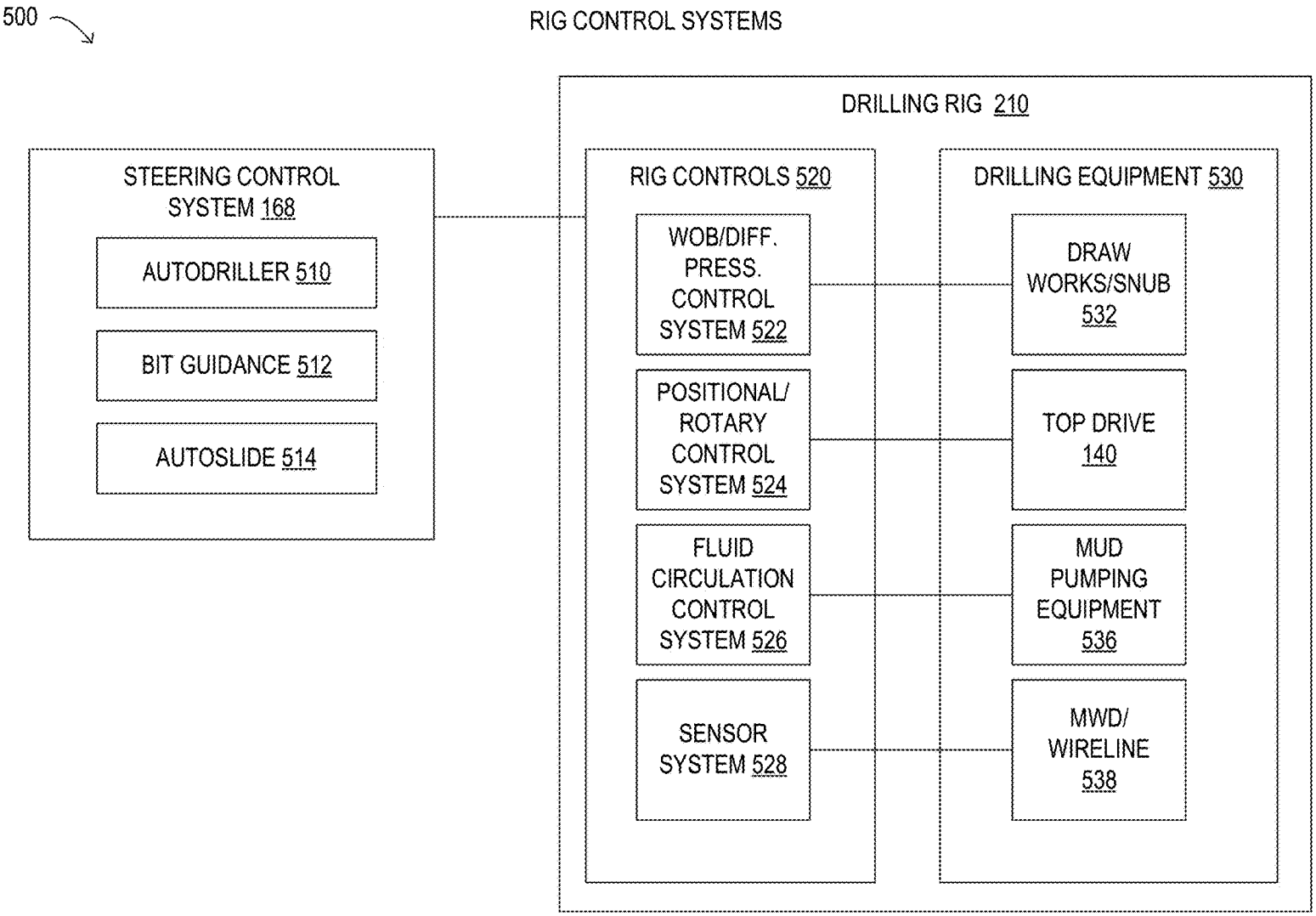
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514, Drilling rig 210 is hierarchically shown including rig controls 520, Which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system. 528, while drilling equipment 530 includes a draw works/snub 532, top drive 140, a mud pumping equipment 536, and an MWD/wireline 538.

Figure 10:
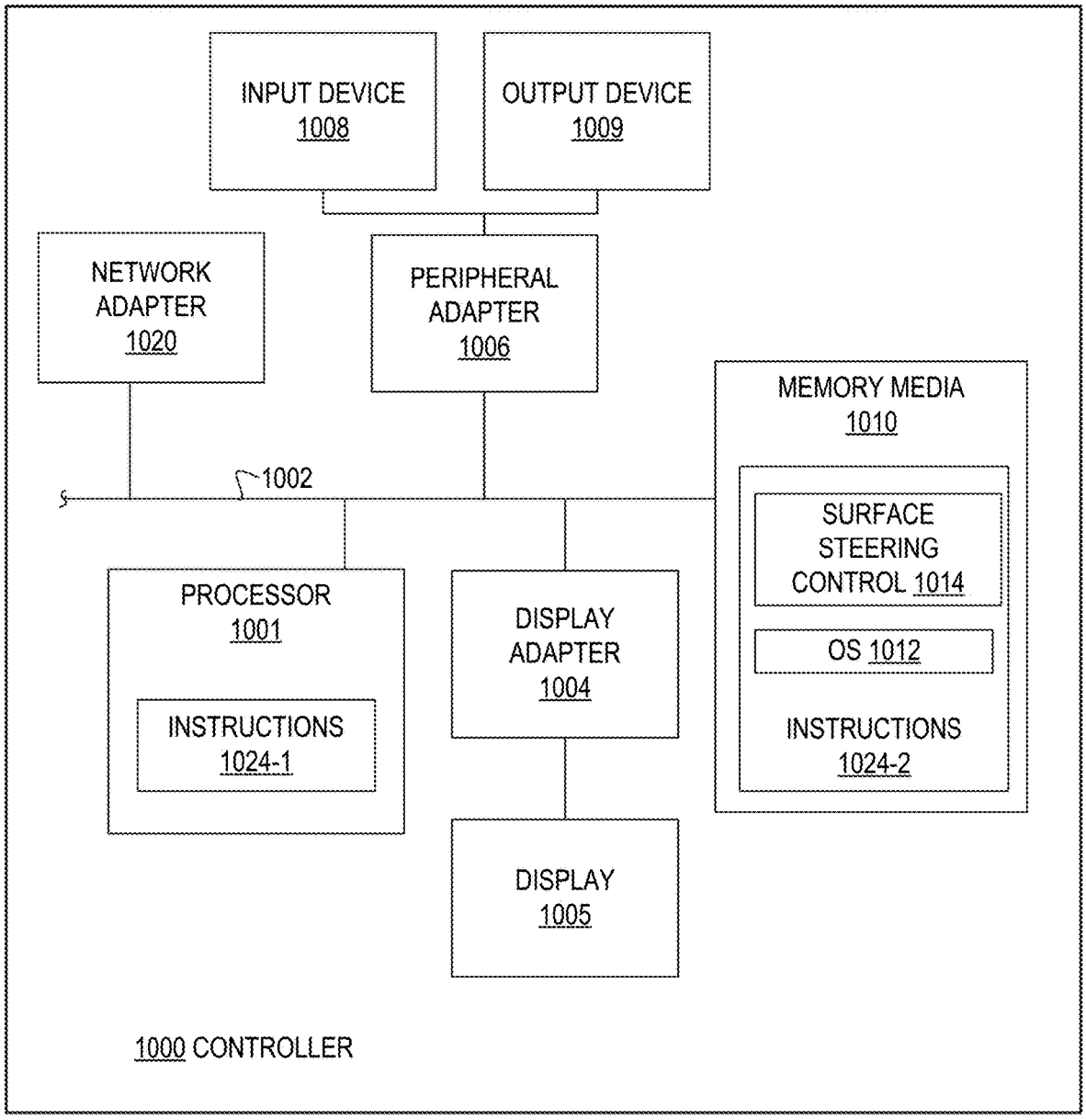
FIG. 10 is a depiction of a controller usable by the rig control systems.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling, and may include certain levels of automation with respect to drilling equipment 530.

In rig control systems 500 of FIG. 5, WOB/differential pressure, control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping equipment 536 to control mud flow and may also receive and decode mud telemetry signals. Sensor system 528 may be interfaced with MWD/wireline 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 521 during a slide, and may return control to steering control system 168 for rotary drilling at an appropriate time, as indicated in the well plan. In particular implementations, autoslide 514 may be enabled to provide a user interface during slide drilling to specifically monitor and control the slide. For example, autoslide 514 may rely on bit guidance 512 for orienting a tool face and on autodriller 510 to set WOB or control rotation or vibration of drill string 146.

Figure 6:
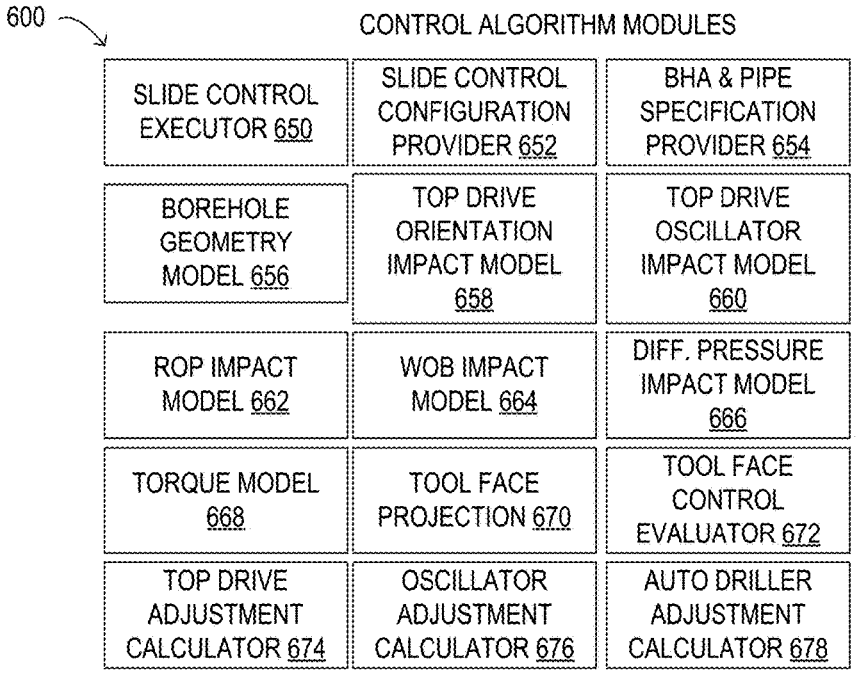
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model. 658 that is responsible for modeling the impact that changes to the angular orientation of top drive 140 have had on the tool face control; a top drive oscillator impact model 660 that is responsible for modeling the impact that oscillations of top drive 140 has had on the tool face control; an ROP impact model 662 that is responsible for modeling the effect on the tool face control of a change in ROP or a corresponding ROP set point; a WOB impact model 664 that is responsible for modeling the effect on the tool face control of a change in WOB or a corresponding WOB set point; a differential pressure impact model 666 that is responsible for modeling the effect on the tool face control of a change in differential pressure (DP) or a corresponding DP set point; a torque model 668 that is responsible for modeling the comprehensive representation of torque for surface, downhole, break over, and reactive torque, modeling impact of those torque values on tool face control, and determining torque operational thresholds; a tool face control evaluator 672 that is responsible for evaluating all factors impacting tool face control and whether adjustments need to be projected, determining whether re-alignment off-bottom is indicated, and determining off-bottom tool face operational threshold windows; a tool face projection 670 that is responsible for projecting tool face behavior for top drive 140, the top drive oscillator, and auto driller adjustments; a top drive adjustment calculator 674 that is responsible for calculating top drive adjustments resultant to tool face projections; an oscillator adjustment calculator 676 that is responsible for calculating oscillator adjustments resultant to tool face projections; and an autodriller adjustment calculator 678 that is responsible for calculating adjustments to autodriller 510 resultant to tool face projections.

Figure 7:
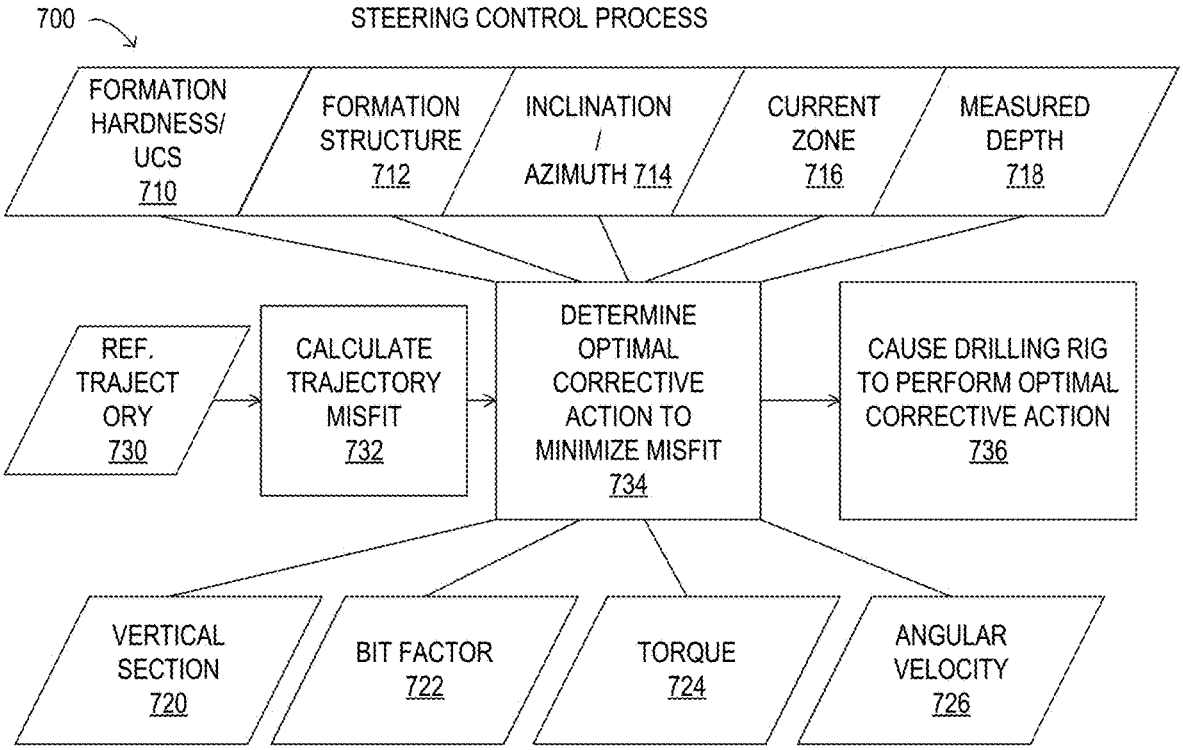
FIG. 7 is a depiction of a steering control process used by the rig control systems.

FIG. 7 illustrates one embodiment of a steering control process 700 for determining a corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired tool face 730, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine a corrective action to minimize the misfit at step 734, which may be performed using the other inputs described above. Then, at step 736, the drilling rig is caused to perform the corrective action.

It is noted that in some implementations, at least certain portions of steering control process 700 may be automated or performed without user intervention, such as using rig control systems 700 (see FIG. 7). In other implementations, the corrective action in step 736 may be provided or communicated (by display, SMS message, email, or otherwise) to one or more human operators, who may then take appropriate action. The human operators may be members of a rig crew, which may be located at or near drilling rig 210, or may be located remotely from drilling rig 210.

Figure 8:
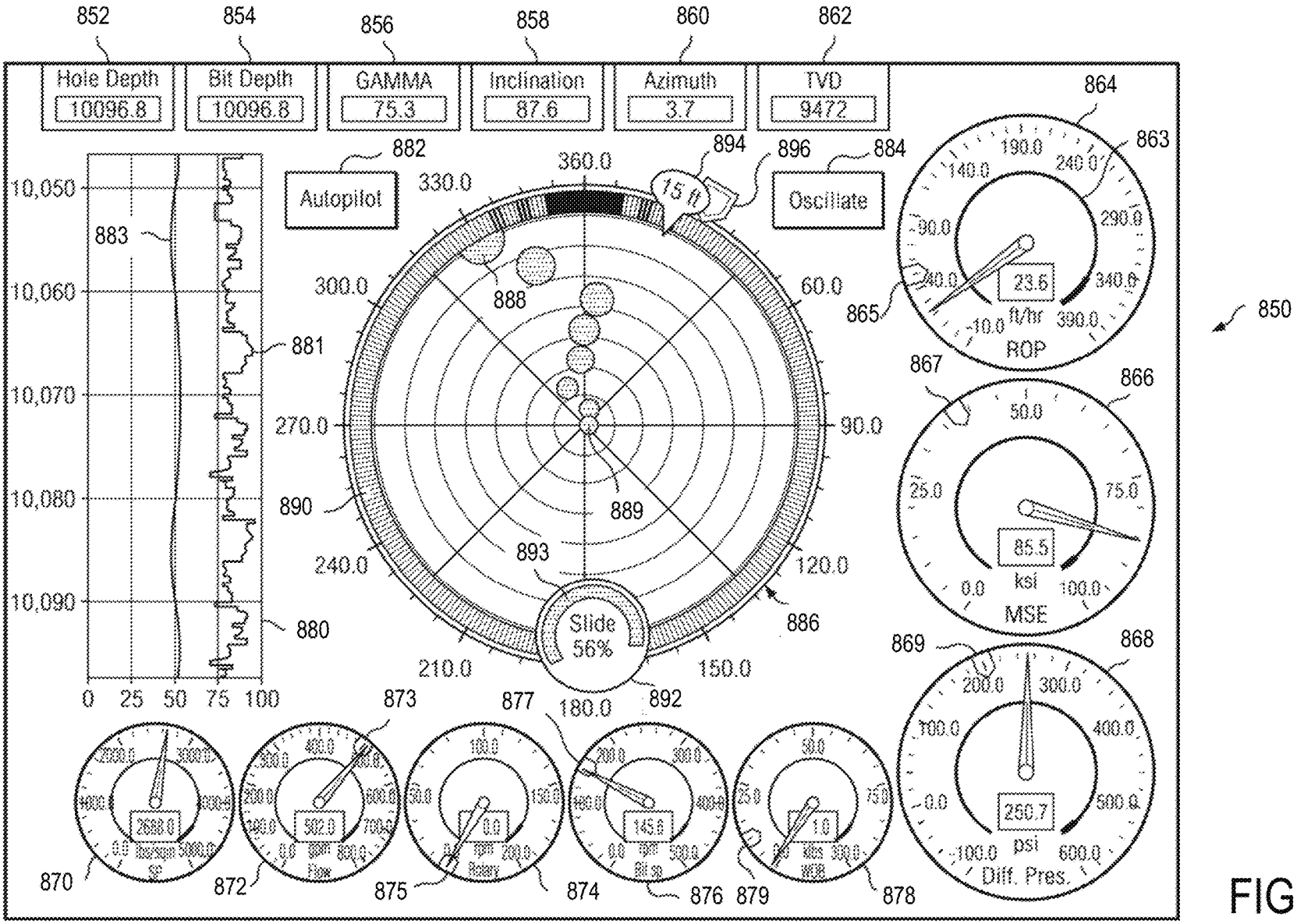
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168.

As shown in FIG. 8, user interface 850 provides visual indicators such as a hole depth indicator 852, a bit depth indicator 854, a GAMMA indicator 856, an inclination indicator 858, an azimuth indicator 860, and a TIM indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 ksi (or 255 MPa). Differential pressure indicator 868 may include a marker 869 indicating that the target value is 200 psi (or 1.38 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gpm (or 31.5 L/s). Rotary RPM indicator 874 may include a marker 875 indicating that the target value is 0 RPM (e.g., due to sliding). Bit speed indicator 876 may include a marker 877 indicating, that the target value is 150 RPM. WOB indicator 878 may include a marker 879 indicating that the target value is 10 klbs (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button. 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical tool face orientation information (e.g., which way the bend is pointed). For purposes of illustration, circular chart 886 represents three hundred and sixty degrees. A series of circles within circular chart 886 may represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees but the center of energy is at 45 degrees.

In user interlace 850, other indicators, such as a slide indicator 892, may indicate bow much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color, Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 868 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
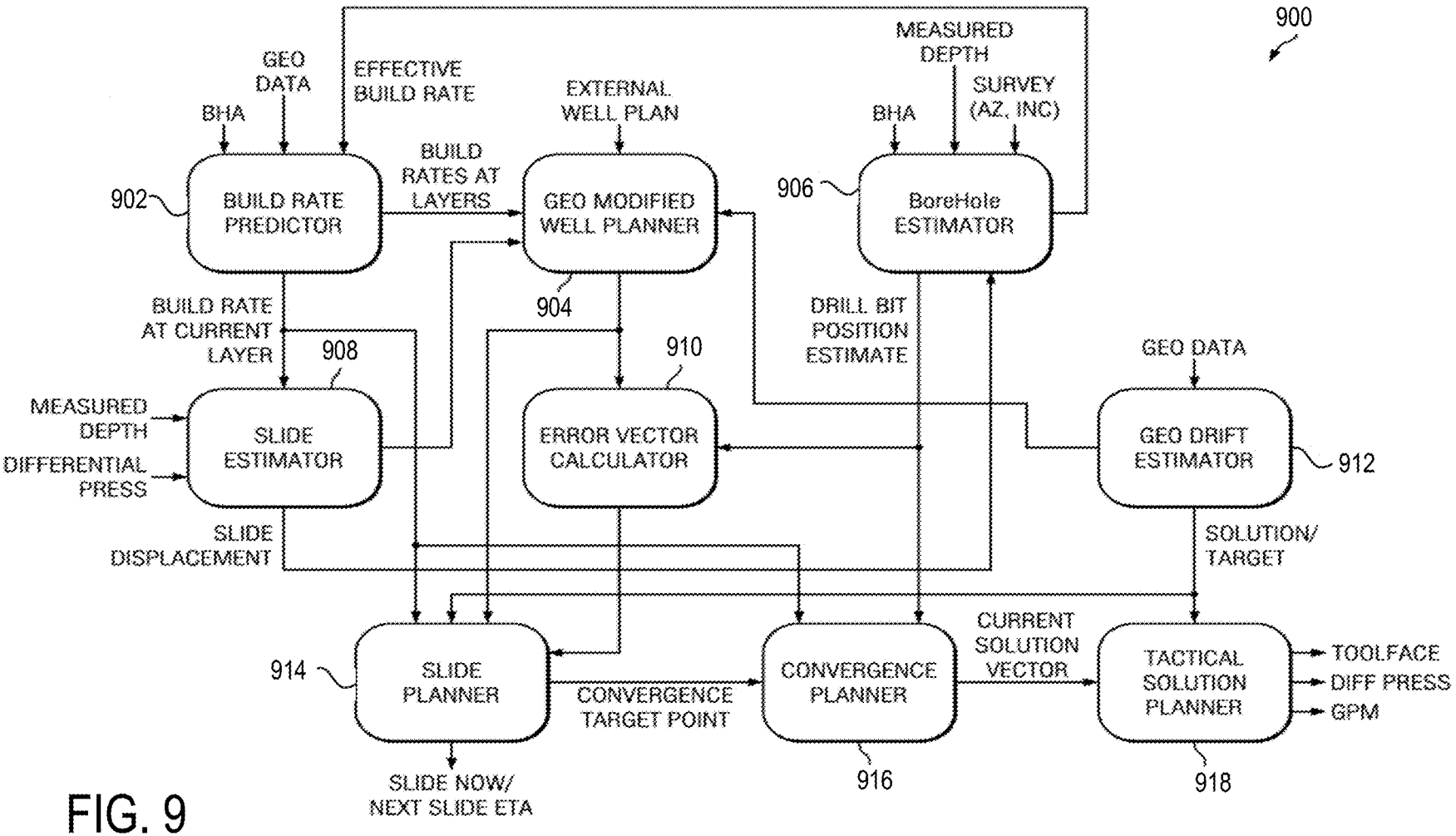
FIG. 9 is a depiction of a guidance control loop performed by the rig control systems.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drill estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good tool face and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization and mud motor bit to bend distance. The geological information may include formation data such as compressive strength, thicknesses, and depths for formations encountered in the specific drilling location. Such information may enable, a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a well plan, internal input from build rate predictor 902 and geo drift estimator 912, and provides output to slide planner 914 and error vector calculator 910. Geo modified well planner 904 uses the input to determine whether there is a more desirable trajectory than that provided by the well plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original well plan. In some embodiments, geo modified well planner 904 may be an optional module that is not used unless the well plan is to be modified. For example, if the well plan is marked in steering control system 168 as non-modifiable, geo modified well planner 904 may be bypassed altogether or geo modified well planner 904 may be configured to pass the well plan through without any changes.

In FIG. 9, borehole estimator 906 may receive external inputs representing BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steeling control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample tool face orientation, differential pressure, measured depth (MD) incremental movement, MSE, and other sensor feedback to quantify-estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each tool face update may be algorithmically merged with the average differential pressure of the period between the previous and current tool face readings, as well as the MD change during this period to predict the direction, angular deviation, and MD progress during the period. As an example, the periodic rate may be between 10 and 60 seconds per cycle depending on the tool face update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the well plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost calculation and plan for sliding activity, which may include factoring in BHA wear, expected build rates of current and expected formations, and the well plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality, for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50 foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the tool face before finishing the slide. During slides, slide planner 914 may provide some feedback as to the progress of achieving the desired goal of the current slide. In some embodiments, slide planner 914 may account for reactive torque in the drill string. More specifically, when rotating is occurring, there is a reactional torque wind up in drill string 146. When the rotating is stopped, drill string 146 unwinds, which changes tool face orientation and other parameters. When rotating is started again, drill string 146 starts to wind back up. Slide planner 914 may account for the reactional torque so that tool face references are maintained, rather than stopping rotation and then trying to adjust to a desired tool face orientation. While not all downhole tools may provide tool face orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and desired convergence target point along the planned trajectory. The convergence plan may take account the amount of sliding/drilling ahead that has been planned to take place by slide planner 914. Convergence planner 916 may also use. BHA orientation information for angle of attack calculations when determining convergence plans as described above with respect to build rate predictor 902. The solution provided by convergence planner 916 defines a new trajectory solution for the current position of drill bit 148. The solution may be immediate without delay, or planned for implementation at a future time that is specified in advance.

In FIG. 9, tactical solution planner 918 receives internal inputs from geological drift estimator 912 and convergence planner 916, and provides external outputs representing information such as tool face orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole tool face. Accordingly, GCL 900 may receive information corresponding to the rotational position of the drill pipe on the surface. GCL 900 may use this surface positional information to calculate current and desired tool face orientations. These calculations may then be used to define control parameters for adjusting the top drive 140 to accomplish adjustments to the downhole tool face in order to steer the trajectory of borehole 106.

For purposes of example, an object-oriented software approach may be utilized to provide a class-based structure that may be used with GCL 900 or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active well plan, and control limits. The drilling model class may produce a control output solution and may be executed via a main processing loop that rotates through the various modules of GCL 900. The drill bit model may represent the current position and state of drill bit 148. The drill bit model may include a three dimensional (3D) position, a drill bit trajectory, BHA information, bit speed, and tool face (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106, The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including, WOB. The positional/rotary model represents top drive or other positional/rotary controls and parameters including rotary RPM and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum RPMS to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable tinier module may enable a default time set to the system time and a time scale of 1.0, may enable the system time of steering control system. 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI) among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

In other embodiments, automated stall recovery for mud motors may be implemented using steering control system 168, as described herein. The automated stall recovery, also referred to herein as "stall assist", may enable various degrees of automation in responding to a mud motor stall that can be configured by a user of steering control system 168, for example. Accordingly, a user interface that is used during drilling, such as user interface 850, may enable activation and configuration of the automated stall recovery, as described in further detail below.

When a mud motor experiences a stall during operation, certain components of the mud motor may become damaged or excessively worn, which is undesirable due to the resulting shortened service life of the mud motor. When the bit torque that turns the bit in the mud motor to cut the formation creates a higher differential pressure than an internal seal of the mud motor (e.g., a power section seal between the rotor and the stator) can maintain, the internal seal may fail under the increased pressure. As a result, the drilling fluid may penetrate the internal seal and may leak through the mud motor without turning the rotor. As the bit ceases rotation or "stalls", the mud motor becomes stalled. When the mud motor stalls, a fast increase in the differential pressure will occur and ROP will diminish to zero. Furthermore, as the drilling fluid leaks past the internal seal, the drilling fluid may erode an elastomer from which the stator is formed, which may lead to further leaks and stalling behavior, and may eventually lead to the stator becoming damaged. Because of the relatively high pressures in the downhole environment, among other factors, the damage to the mud motor components during a mud motor stall, such as chunking of the stator, can occur quickly when a stall occurs. The large pressure pulses generated as a result of the mud motor stalling may, in turn, lead to large and essentially instantaneous torque spikes that can cause stator chunking, connection back-off, fracture of driveline components, or various combinations thereof. The pressure spikes in the mud equipment (e.g., mud pumping equipment 536) can blow pop-off valves, causing further delays and remediation effort to resume drilling.

Although mud motor stalling is a known concern and precautions may be taken to avoid mud motor stalling when drilling using steering control system 168, mud motor stalling may occur nonetheless, such as due to unforeseen drilling situations or environments. When mud motor stalling does occur, a proper and timely detection and remediation of the stall condition is highly desirable to avoid adverse results. For example, if the mud motor bit is picked up off-bottom while drilling, the trapped torque within drill string 146 may become released uncontrollably, which may potentially cause damage to downhole components or cause connections to back off, which are undesirable outcomes during drilling.

Accordingly, in order to respond to a stalled mud motor during drilling of a well, certain recommended practices have been formulated for operators of drilling rigs. The actions performed in response to detecting a stalled mud motor may involve a particular sequence of actions. At the first sign of a stalled mud motor, if drill string 146 is being rotated by top drive 140, rotation should be stopped. Then, a mud system may stop mud pumping. Any residual (or 'trapped') torque in drill string 146 is released.

After the residual torque has been released from the drill string 146, the drill string 146 may be raised, in order to completely disengage the bit and mud motor from the formation. Once drill string 146 has been raised sufficiently off-bottom, the procedure to resume drilling operations may be initiated.

The stall response procedure outlined above is typically performed by the rig crew, such as by the toolpusher and the driller, and may be specified as operational requirements for the drilling rig. The stall response procedure may further specify certain actions to be avoided under any circumstances, such as initiating mud circulation by mud pumping equipment 536 while the mud motor is on-bottom and the bit is engaged with the formation, or rotating the drill string continuously while mud pumping equipment 536 is stopped.

It has been observed that drilling and directional drilling can comprise complex operations during which a multitude of information and variables are subject to monitoring and interpretation. As disclosed herein, steering control system 168 provides various functionality to perform monitoring, interpretation, and/or control of drilling operations. As will be disclosed in further detail below, steering control system 168 may further comprise functionality for stall detection and recovery for mud motors. The stall detection and recovery for mud motors disclosed herein may provide a greater benefit and more advantages than simply automating routine tasks in software that were previously performed manually. Specifically, the stall detection and recovery for mud motors disclosed herein may be enabled to detect a motor stall with greater accuracy and within a shorter detection time than the rig crew could manually detect, which may help in avoiding false positives, false negatives, and undesirable delays typical in manual detection that can cause further damage to equipment. Furthermore, the stall detection and recovery for mud motors disclosed herein may be enabled to automatically react to the detected motor stall by immediately taking corrective actions for remediation of the motor stall. Again, such a reaction by steering control system 168 (implementing the stall detection and recovery for mud motors) can provide a greater benefit and more advantages than simply automating routine tasks in software that were previously performed manually, because steering control system 168 can be programmed to respond faster and with fewer potential errors in judgement or execution of control commands than a human rig crew, which may significantly reduce the risks of damage to the mud motor after a motor stall occurs. Also, the stall detection and recovery for mud motors disclosed herein may be, configured for various degrees of manual control and intervention, either for detecting the motor stall or for responding to the motor stall, which may be independently configurable from each other.

As noted, the stall detection and recovery for mud motors disclosed herein may enable steering control system 168 to aid in quick detection and remediation of mud motor stalls while drilling. The on-bottom drilling may include rotation of drill string 146 or may be slide drilling without rotation. The automated stall recovery for mud motors disclosed herein may be implemented as a "stall assist" feature that augments the functionality of steering control system. 168, for example, by adding certain display or control elements to user interface 850 (see also FIGS. 12A-F), or may be implemented with one or more separate control systems. The stall assist functionality of steering control system 168 may be enabled to perform monitoring to automatically detect a motor stall, and may be enabled to perform monitoring and control to automatically respond to the motor stall to prevent damage to the mud motor, before handing back control to the driller once the motor stall has been remediated.

In some embodiments, indications or an analysis of the drilling, such as related to monitoring the differential pressure, may be used to determine a likelihood of a motor stall or to predict a motor stall in advance. Specifically, steering control system 168 implementing stall assist may also be programmed to predict a stall before it occurs. Data regarding the mud motor, including its maximum pressure rating, may be provided by an operator, and in addition, data regarding the formations to be drilled according to the drill plan, as well as data regarding stalls that have occurred earlier during drilling of the same well and/or other wells, can be provided and used by steering control system 168. Such data may include data regarding a variety of drilling parameters, including weight on bit, rate of penetration, differential pressure, flow rates for drilling mud, and so forth, wherein each of the data points regarding such parameters correspond to one another, either by time or by location within a wellbore. The data may be stored in a separate database accessible by steering control system 168. Steering control system 168 can be programmed to compare the current values for a plurality of drilling parameters (e.g., DP, ROP, WOB, mud flow rates, etc.), as well as data regarding the mud motor and/or BHA (e.g., manufacturer's pressure rating), to the database of data for drilling parameters associated with an earlier mud motor stall to determine if the difference between the current values during drilling of a wellbore and the data values for some or all of the same parameters that are associated with an earlier stall fall within a threshold (or one or more thresholds), if such a threshold determination is positive, then steering control system 168 may automatically generate a signal indicating that a stall may be imminent (such as a visual alert on a display, an audible alarm, an email or text message, or the like). In other instances, steering control system 168 may take other appropriate action, which may include sending one or more control signals to one or more control systems of the drilling rig, such as to change drilling parameters like ROP, WOB, DP, mud flow rates, etc. to try to prevent a stall from happening, to minimize the effects of the potential stall, and/or to recover from a stall as described in this disclosure. The database may, for example, comprise a lookup table, such that steering control system 168 obtains the data values in the table that correspond to one or more recently measured values for DP and, from such data values and from outcome data associated with such values or from comparing some or all of them to one or more thresholds, determines whether the likelihood of a stall is high enough that an indication of an imminent stall is appropriate.

Figure 11:
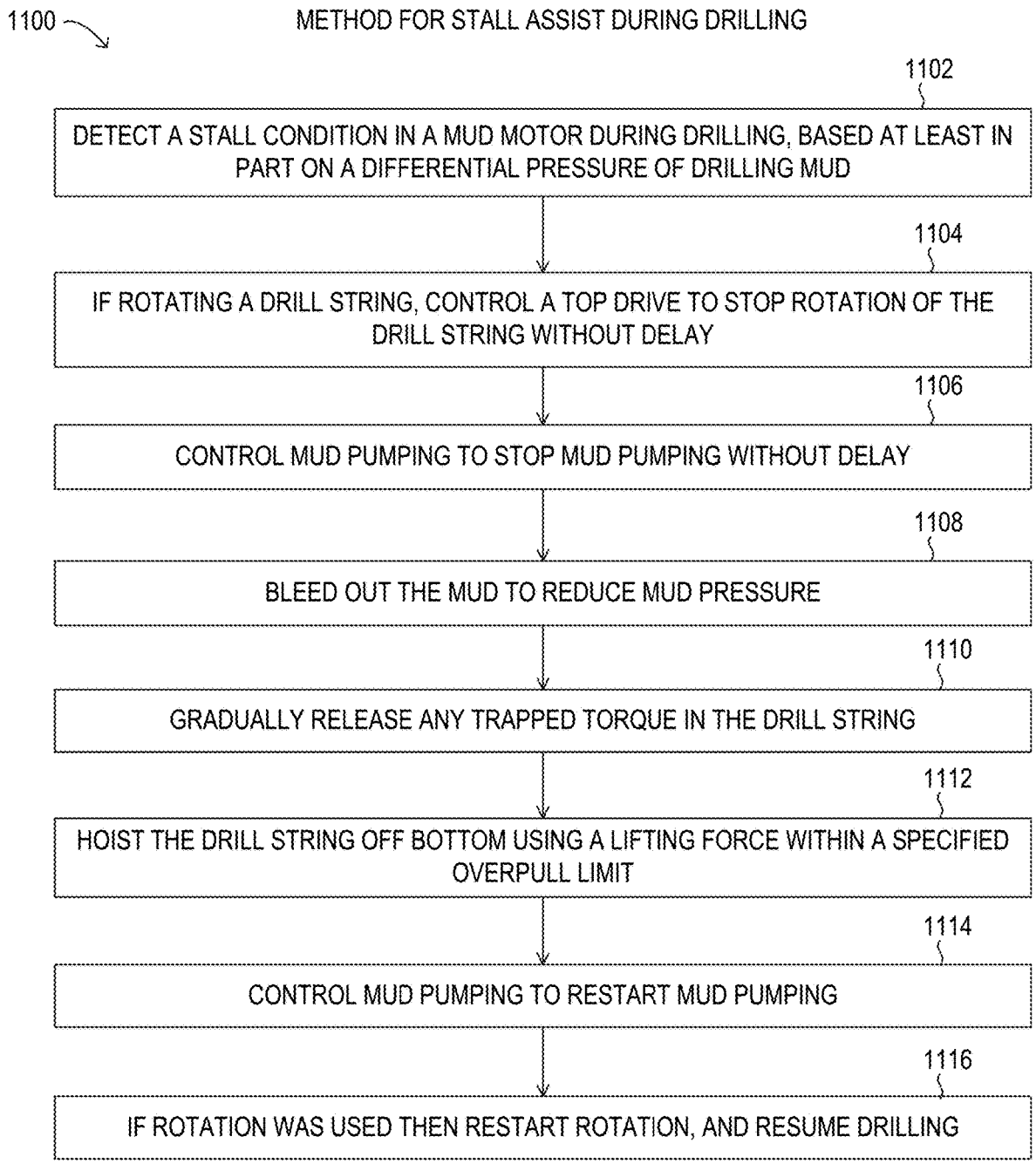
FIG. 11 is a flowchart of a method for stall assist during drilling.

Referring now to FIG. 11, a method 1100 for stall assist during drilling, is shown as a flow chart. Method 1100 may be performed by steering control system 168, as described herein, or may be implemented with one or more separate control systems. It is noted that certain operations in method 1100 may be optional or rearranged, in different implementations. As described below, method 1100 is explained based on automatic implementation of stall detection and stall remediation. Various degrees of manual control and semi-automatic control are explained in further detail with regard to the user interfaces for stall assist shown in the examples depicted in FIGS. 12A-F.

Method 1100 may begin at step 1102 by detecting a stall condition in a mud motor during drilling, based at least in part on a differential pressure of drilling mud. It is noted that steering control system 168 may be enabled to monitor the differential pressure and detect the stall condition in a shorter time and with greater certainty than a human operator. For example, the following conditions may be used by steering control system 168 to detect the motor stall, such as when threshold conditions are met by differential pressure values such as:

- differential pressure is at or above 130% of $DP_{mm}$ for at least 3 seconds; or
- differential pressure rises to 150% of $DP_{min}$ within 1 second and remains at or above 150% of $DP_{mm}$ for at least 1 second.

In the above terms, $DP_{mm}$ represents the continuous operating pressure rating for the mud motor. It will be understood that the above conditions are exemplary and that various different kinds of conditions, including various different threshold levels for differential pressure and various different time periods or transient periods may be used, either alone or in combination. Because a human operator, such as a driller, is highly unlikely to accurately detect a motor stall within a few seconds of a spike in differential pressure occurring, step 1102 provides greater benefit than simply automating the manual detection of the motor stall by the human operator, such as by saving valuable drilling and rig time that may be lost due to a false negative detection. For example, even when the human operator is operating user interface 850 and is presented with differential pressure indicator 868, the human operator may take significantly more than a few seconds to notice and comprehend a sudden spike in the differential pressure, and may still be unable to accurately judge a cumulative time of increased differential pressure. Also, because steering control system 168 may monitor the differential pressure directly at surface 104 (e.g., at mud pumping equipment 536), steering control system 168 may be programmed to recognize the spike in differential pressure independently of user interface 850, such as before user interface 850 can be updated or refreshed, Which may also depend at least in part on downhole data. In certain implementations, automatic detection of the stall may be performed in the background and a visual indication (or another type of an alert) of a detected stall may be displayed on user interface 850 or another user interface (see also FIGS. 12A-F).

Although the above threshold conditions have used changes or transients in differential pressure to detect a mud motor stall, the detection may be performed using other input values, such as one or more drilling parameters. It is rioted that, when a mud motor stall occurs, ROP drops to zero and such a measurement value may also be used in conjunction with the differential pressure. For example, a secondary condition to confirm that ROP is below a minimum threshold value may also be used to detect, or to confirm detection of the mud motor stall. As an another example, one or more additional thresholds may be established using a combination of differential pressure and ROP (or other drilling parameters) and used in addition to the two threshold examples provided above with respect to differential pressure. For example, it may be that the differential pressure has not increased sufficiently in value or in rate of change to exceed one of the two thresholds mentioned above, yet it may be that the increase in differential pressure, when taken together with a decrease in the ROP or a rate of change in the ROP, is nonetheless indicative of a stall, or may indicate an impending stall.

In method 1100, at step 1104, if rotating a drill string, a top drive is controlled to stop rotation of drill string 146 without delay. If not rotating drill string 146 (e.g., slide drilling), step 1104 may be omitted. Step 1104 may involve controlling top drive 140 to stop rotation of drill string 146 in a deliberate and smooth manner, yet without delay. Because steering control system 168 can react within a much smaller delay than the rig crew, step 1104 may result in stopping drilling faster than the human operator can react to. In particular embodiments, the rotation of top drive 140 may be stopped without applying a friction brake, but rather, the rotation may be slowed in a gradual and controlled manner to a stop, yet without delay, using an electric motor brake or controlling the top drive motor accordingly. In this manner, the rate at which top drive 140 is stopped may be faster than a standard control system would stop top drive 140, such as when the driller normally turns off rotation, for example. At step 1106, mud pumping is controlled to stop mud pumping without delay. Because steering control system 168 can react within a much smaller delay than the human rig crew, step 1106 may result in stopping mud pumping equipment 536 faster than the human operator can react to, including reducing the standpipe pressure. At step 1108, the mud is bled out to reduce mud pressure. Step 1108 may be performed using a control valve in mud pumping equipment 536. In some embodiments, step 1108 is performed by receiving an instruction to mud pumping equipment 536, which is equipped with a diaphragm-type pulsation dampener with hydraulic oil therein and an associated control valve in fluid communication with the standpipe. The mud pressure within the hydraulic side of the pulsation dampener would be released in a controlled manner, allowing mud from the standpipe to enter the pulsation dampener and relieve the residual pressure on the standpipe. After relief of the pressure, the pulsation dampener may then be refilled with hydraulic oil and can be used for the next pressure relief request.

At step 1110, any trapped torque in drill string 146 is gradually released. For example, steering control system 168 may be enabled to release the trapped torque over a desired minimum time period, such as by controllably unwinding drill string 146 (by controlling top drive 140), in order to release the trapped torque in a controlled and gradual manner to avoid damaging other drill string components. Steering control system may control the release of any residual torque by unwinding, drill string 146 at a predetermined rate or for a predetermined time in a direction opposite to the measured residual torque, and may cease unwinding drill string 146 once the measured torque value reaches zero and/or remains below a predetermined threshold value for a predetermined time period, for example.

At step 1112, drill string 146 is hoisted off bottom using a lifting force within a predetermined overpull limit. Other parameters for hoisting drill string 146 may also be provided as user input to steering control system 168 to perform step 1112, such as a hoist distance and a hoist velocity. Steering control system 168 may be enabled to hoist drill string 146 off-bottom for various depths and may automatically accommodate different lengths and weights of drill string 146, while the overpull limit may be a parameter that is user-specified. After drill string 146 is off bottom, drilling with the mud motor can resume. At step 1114, mud pumping is controlled to restart mud pumping. At step 1116, if rotation was used then the rotation is restarted, and drilling resumes. At step 1116, various procedures may be performed to resume drilling with the mud motor on-bottom, such as resuming rotary drilling or toolface alignment, among others.

Referring now to FIGS. 12A, 12B, 12C, 12D, 12E, and 12F (FIGS. 12A-F), depictions of user interfaces for enabling stall assist during drilling are shown. The user interfaces in FIGS. 12A-F show a configuration panel for the stall assist functionality describe herein. The user interfaces in FIGS. 12A-F may be implemented by steering control system 168, along with various other user interfaces and user interface elements. For example, the user interfaces in FIGS. 12A-F may be accessible from a main button in user interface 850 associated with the stall assist functionality. It is also noted that other control or display elements associated with the user interfaces in FIGS. 12A-F may be shown or used by steering control system 168. The functionality described below with respect to the user interfaces in FIGS. 12A-F, in particular the different ways of enabling and disabling automatic functionality, may be variously implemented in different embodiments.

Figure 12A:
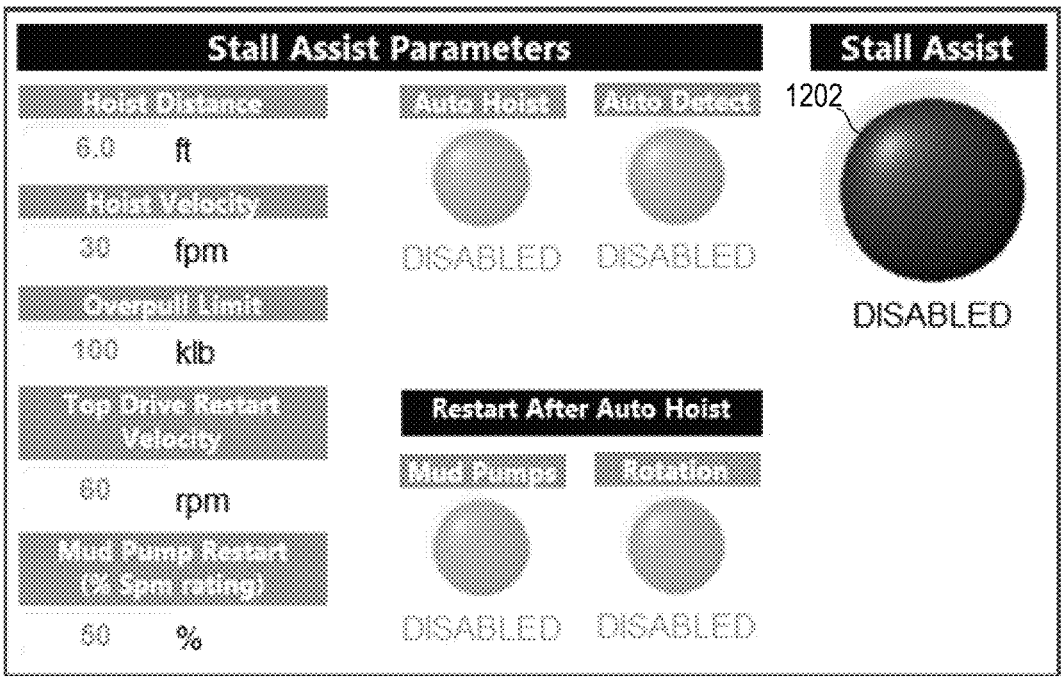
FIGS. 12A, 12B, 12C, 12D, 12E, and 12F are depictions of user interfaces for enabling stall assist during drilling.

In FIG. 12A, a boolean control 1202 is a main control element to enable or disable the stall assist functionality and is shown having a disabled value, with various stall assist parameters and settings being inactive and greyed out (e.g., inaccessible to the user), shown in FIGS. 12A-F for descriptive clarity. It is noted that other states for control elements than the inactive state may be used. For example, the control elements may remain accessible even when the control element is not used for stall assist in a given situation. When the stall assist is disabled, as in FIG. 12A, steering control system 168 may perform no automatic detection or remediation of motor stalls.

Figure 12B:
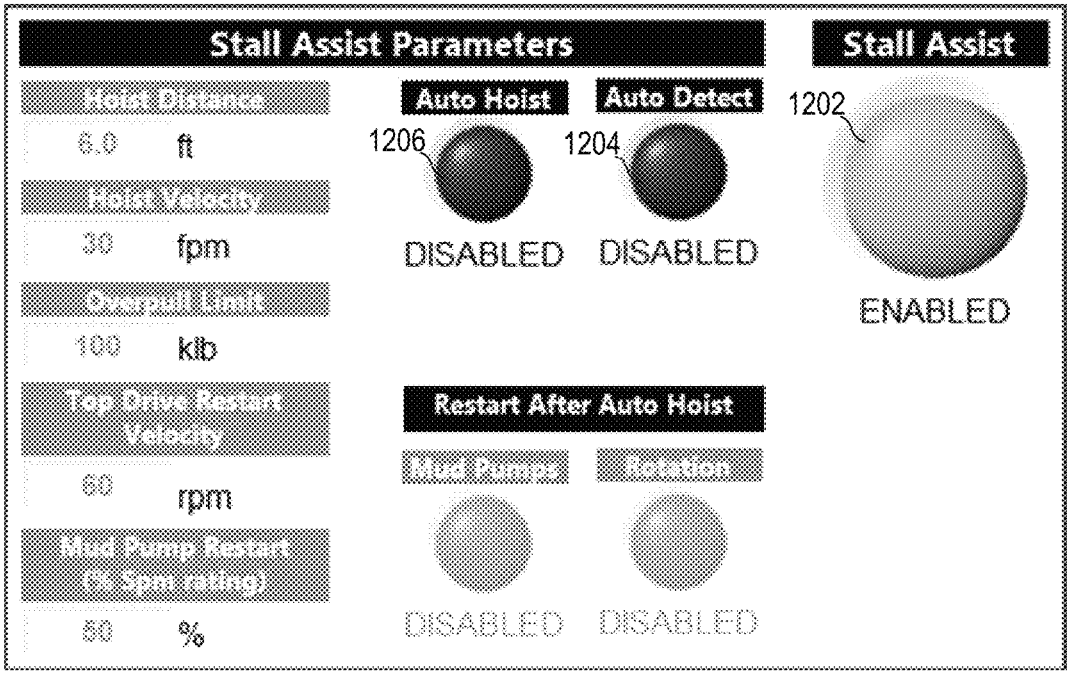

In FIG. 12B, boolean control 1202 has an enabled value, while boolean controls 1204 (Auto Detect) and 1206 (Auto Hoist) are activated for use by the user and have the disabled value. In the operating state shown in FIG. 12B, stall assist may still automatically detect a motor stall, but will present the results of the stall detection to the user and may take no further automatic action without user input. Furthermore, stall assist with these settings will not perform automatic hoisting, but may still present a dialog box to the user to manually initiate or control the hoisting.

Figure 12C:
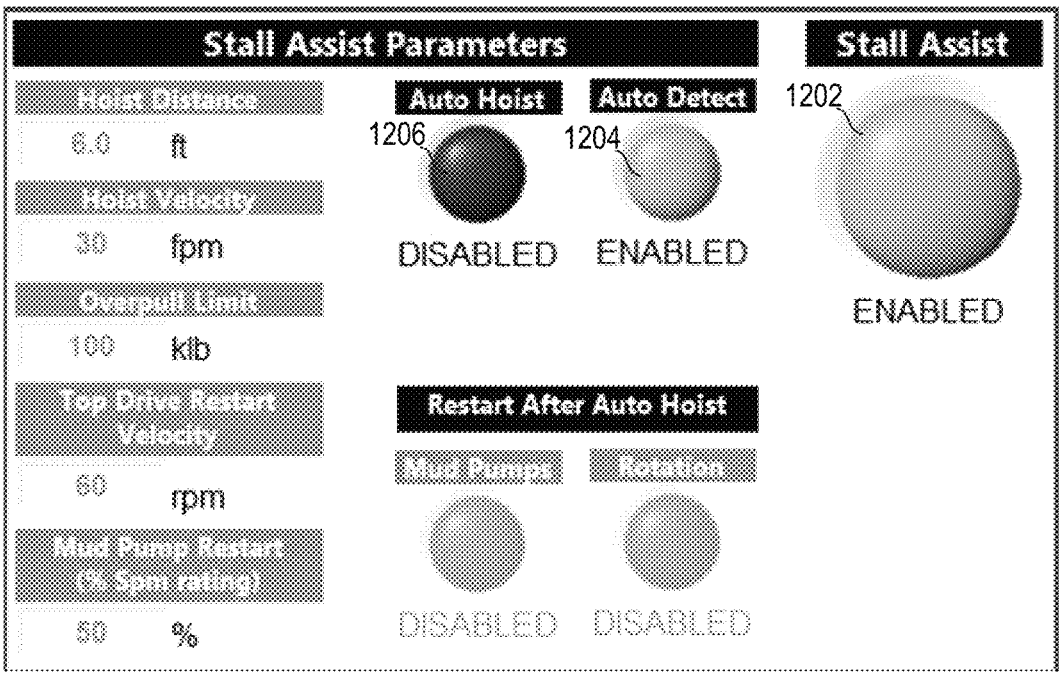

In FIG. 12C, boolean control 1204 has an enabled value, and stall assist will accordingly automatically detect a motor stall. In some implementations, stall assist may perform steps 1102, 1104, and 1106 whenever a motor stall occurs and boolean control 1204 has the enabled value. It is noted that boolean control 1206 may have the enabled value while boolean control 1204 has the disabled value (not shown), such that manual intervention is requested to detect the stall, while the Auto Hoist functionality is automatically performed alter stall detection is manually validated.

Figure 12D:
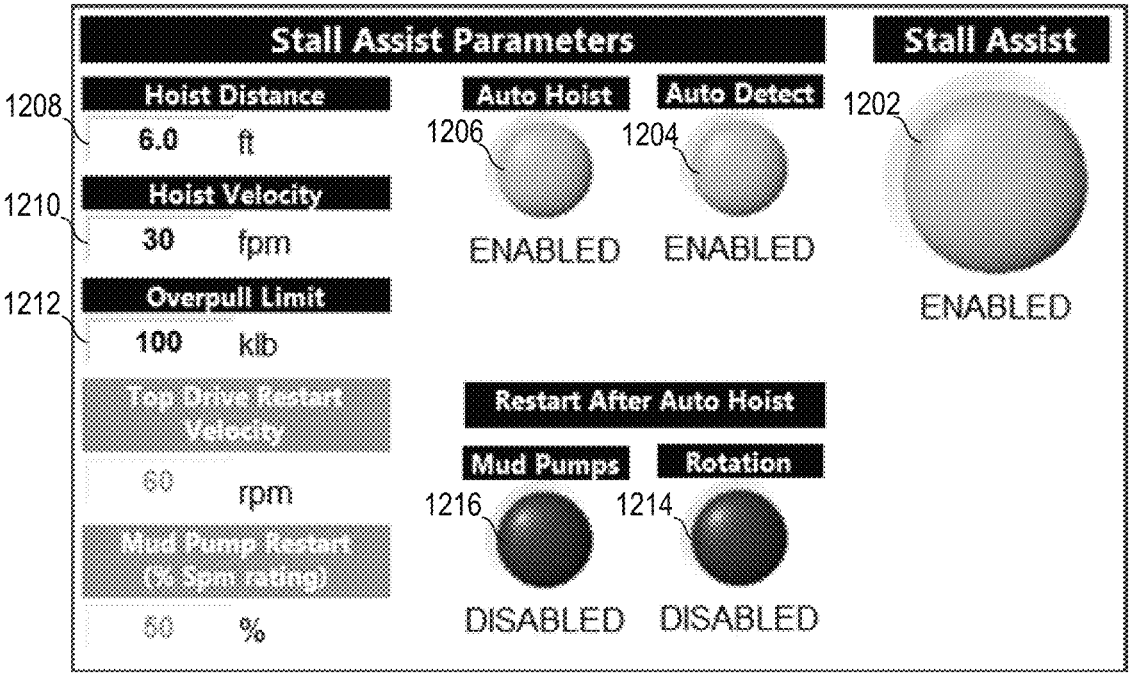
Figure 12E:
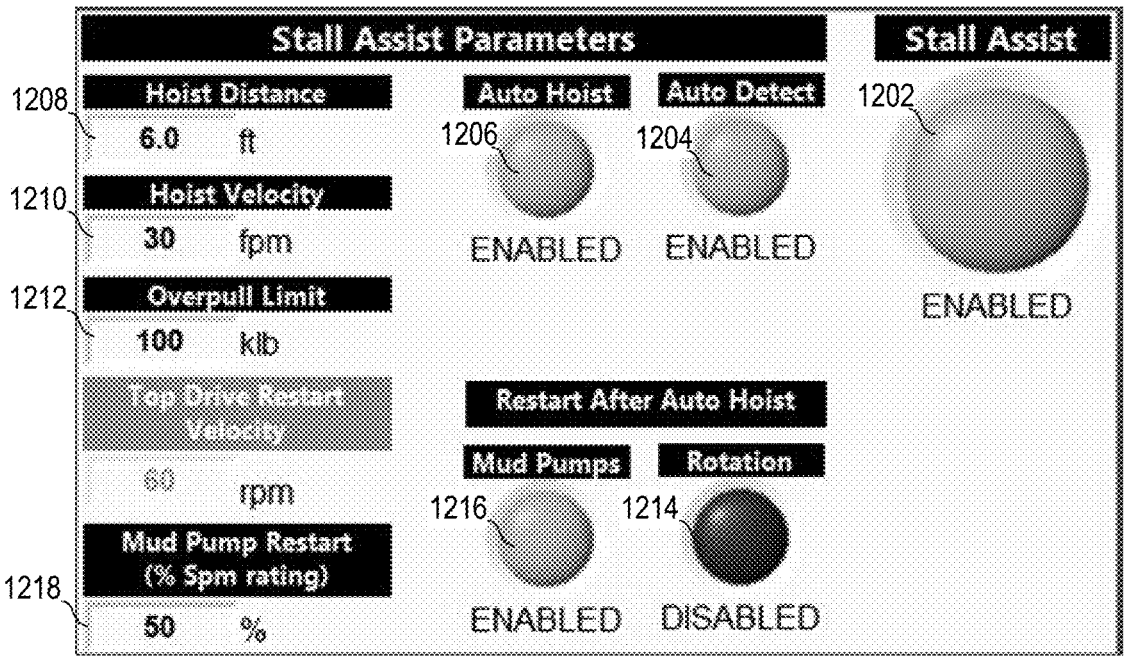
Figure 12F:
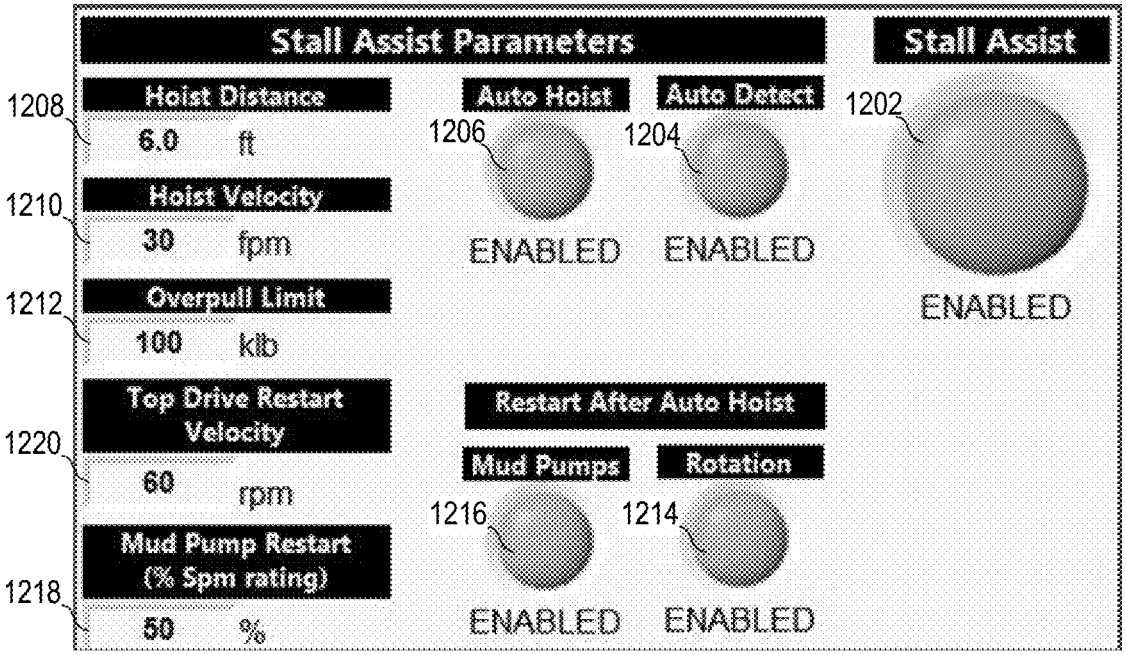

In FIG. 12D, boolean control 1206 has an enabled value, indicating activation of the Auto Hoist functionality, which causes numeric controls 1208, 1210, 1212 to be activated for use by the user. The Auto Hoist functionality may result in steps 1108 and 1110 being performed automatically, such as immediately after step 1106. Numeric control 1208 provides Hoist Distance in feet; numeric control 1210 is Hoist Velocity provides feet/min; and numeric control 1212 provides Overpull Limit in kilo-pounds, indicating a maximum amount of lift force in excess of the weight of drill string 146 that is applied during the Auto Hoist procedure. Additionally, in FIG. 12D, boolean control 1214 (Rotation) and Boolean control 1216 (Mud Pumps) are now activated for use by the user, and are both shown having a disabled value under the heading Restart After Auto Hoist. An enabled value of boolean control 1214 (Rotation) results in controlling top drive 140 to restart rotation of drill string 146 if rotation was performed prior to the mud motor stall. If rotation was not performed prior to the mud motor stall, boolean control 1214 may have no effect. An enabled value of boolean control 1216 (Mud Pumps) results in mud pumping equipment 536 being automatically reactivated alter the Auto Hoist procedure in FIG. 12E, boolean control 1216 (Mud Pumps) has an enabled value, which causes a numeric control 1218 (Mud Pump Restart) to become active for use by the user and defines a speed setting for the mud motor upon restarting after Auto Hoist. In FIG. 12F, boolean control 1214 (Rotation) has an enabled value, Which causes a numeric control 1220 (Top Drive Restart Velocity) to become active for use by the user and defines a rotational velocity in rpm to turn drill string 146 after the Auto Hoist feature (when rotation was enabled prior to the stall).

Based on the configurational functionality shown in exemplary FIGS. 12A-F, various degrees of manual, semi-automatic, and automatic control of the stall assist may be implemented, while retaining many of the benefits described herein. For example, the following degrees of automation may be implemented:

a. Manual—The operator is notified of a motor stall and is presented with a STOP STALL button that automatically stops rotation (if used), immediately turns off mud pumping equipment 536, and gradually releases trapped torque in drill string 146. Subsequent remediation actions, such as hoisting off bottom and restarting drilling may be performed by the human operators;
b. Semi-automatic—Same as Manual, but with AutoHoist being activated automatically as soon as the standpipe pressure is reduced and the trapped torque in drill string 146 is released. The AutoHoist may be configured using user-provided parameters. Restarting drilling may be performed by the human operators; and
c. Automatic—Same as Semi-automatic, but with restarting drilling being automatically performed.

It will be understood that the above classifications are exemplary and non-limiting, and may be variously grouped for different functionality in other embodiments. For example, various specific parameters associated with the stall assist function may be added to the user interfaces shown in FIGS. 12A-F, or to other user interfaces, such as but not limited to mud motor ratings (maximum differential pressure DPmm, maximum angular velocity) or other stall ratings, pressure specifications or downhole components, such as the liner or casing wall, among others.

Additionally, other safeguards to prevent undesired or improper pressure from being applied to the mud motor may be employed, such as constraining user inputs for controlling pressure such that a user input greater than the specified pressure rating for the mud motor cannot be entered into the user interface by the user, and so cannot be applied by steering control system 168. In some implementations, additional text may be displayed near a stall assist activation button that advises the user about events that are occurring during a stall or during handling of a stall by the auto stall functionality. In some cases, the number of stalls that have occurred during drilling of a well, or a portion of a well, may be shown as a separate stall counter. Various different visual, audible, and electronic (e.g., text, email, etc.) alerts or alarms may also be generated for stall assist, such as a general alarm when a stall is detected.

Additional or different constraints may also be applied to the stall detection threshold conditions used to detect a mud motor stall. For example, the stall threshold differential pressure value may be specified as at least 2.0% larger than the maximum differential pressure that the mud motor is rated at, and conversely the maximum differential pressure may be specified to be greater than 80% of the stall threshold differential pressure value.

When a user of steering control system 168 inputs a differential pressure setpoint, the auto stall function may consider an available pressure margin before a maximum liner/casing rating pressure is reached. If the maximum liner/casing rating pressure is smaller than the maximum rated differential pressure of the mud motor, then the autodriller can be limited to the smaller value and the entry for maximum motor differential pressure may be shown turn red, indicating that the maximum input value is not available. For the stall threshold differential pressure, the standpipe rating can applied, and the minimum of 20% separation can still be enforced. For example, if the input stall threshold differential pressure is not available, the displayed stall threshold differential pressure value may turn red. The pressure limit setting may also be used to determine which maximum differential pressure set point is available to the autodriller.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method for detecting a stall of a mud motor during drilling, the method comprising:

providing a drilling mud to a mud motor from a drilling mud system during drilling of a wellbore to a drill bit powered by the mud motor;

providing a plurality of differential pressure values of the drilling mud to a stall detection system;

determining, by the stall detection system, a differential pressure value is at or above a first threshold value for a minimum of a first predetermined time period or if the differential pressure value increases to a second threshold value within a second predetermined time period, wherein the first threshold value and the second threshold value are based on a percentage value above a continuous operating pressure rating for the mud motor; and responsive to the determining, providing an indication of a stall when the differential pressure value is at or above the first threshold value for a minimum of the first predetermined time period, or if the differential pressure value increases to the second threshold value within the second predetermined time period, wherein the second threshold value is more than the first threshold value and the second predetermined time period is less than the first predetermined time period.

2. The method according to claim 1, wherein the first threshold value is more than 100% of the continuous operating pressure rating for the mud motor.

3. The method according to claim 2, wherein the first threshold value is more than 120% of the continuous operating pressure rating for the mud motor.

4. The method according to claim 2, wherein the second threshold value is more than 130% of the continuous operating pressure rating for the mud motor.

5. The method according to claim 1, further comprising the step of providing, by the stall detection system, a signal indicating a mud motor stall to at least one control system for at least one item of equipment of a drilling rig that is drilling the wellbore.

6. The method according to claim 5, wherein the at least one item of equipment is at least one of a top drive, a drilling mud pump, a hoist, and a display for an operator.

7. A method for recovering from a mud motor stall, the method comprising: providing an indication of a mud motor stall by at least determining that (i) a differential pressure value is at or above a first threshold value and (ii) remains at or above the first threshold value for a minimum of a first predetermined time period; and providing an automated stall recovery system, wherein the automated stall recovery system in response to the indication of the mud motor stall performs the following steps:

when the indication of a mud motor stall occurs during rotary drilling of a borehole, controlling a top drive on a drilling rig that is rotary drilling a wellbore to cease rotation of a drill string to which a mud motor is attached;

controlling a mud pump to cease pumping drilling mud into the borehole;

controlling a release of any residual torque in the drill string;

controlling a release of pressure in the drilling mud;

controlling a hoisting of the drill string off bottom by a predetermined amount;

controlling the mud pump to restart pumping of the drilling mud;

controlling the top drive to restart rotation of the drill string if the indication of the mud motor stall occurred during rotary drilling; and controlling a resumption of engaging a drill bit with a formation being drilled.

8. The method according to claim 7, wherein the controlling of the top drive is performed without applying a friction brake.

9. The method according to claim 7, wherein the controlling of the top drive is performed with an electric motor brake.

10. The method according to claim 7, wherein the controlling of the release of any residual torque further comprises:

unwinding the drill string in a direction opposite to a measured residual torque value; and ceasing unwinding the drill string once the measured residual torque value reaches zero and remains below a predetermined value for a predetermined time period.

11. An automatic stall detection and recovery system, the system comprising:

a processor connected to one or more control systems of a drilling rig enabled to drill a borehole;

a memory connected to the processor, wherein the memory comprises instructions for performing a plurality of the following:

receiving a plurality of differential pressure values of a drilling mud used for drilling;

determining that a first differential pressure value of the plurality of differential pressure values is at or above a first threshold value;

determining that a subset of the plurality of differential pressure values subsequent to the first differential pressure value remain at or above the first threshold value for a minimum of a first predetermined time period;

responsive to the determining, providing an indication of a stall when the first differential pressure value is at or above the first threshold value and the subset of the plurality of differential pressure values remain at or above the first threshold value for the minimum of the first predetermined time period;

when the indication of a mud motor stall occurs during rotary drilling of a borehole, controlling a top drive on the drilling rig that is rotary drilling a wellbore to cease rotation of a drill string to which a mud motor is attached;

controlling a mud pump to cease pumping the drilling mud into the borehole;

controlling a release of any residual torque in the drill string, wherein the residual torque is released in a gradual manner;

controlling a release of pressure in the drilling mud; and controlling a hoisting of the drill string off bottom by a predetermined amount.

12. The system according to claim 11, wherein the instructions further comprise instructions for:

controlling the mud pump to restart pumping of the drilling mud;

controlling the top drive to restart rotation of the drill string if the indication of the stall occurred during rotary drilling; and controlling a resumption of engaging a drill bit with a formation being drilled.

13. The system according to claim 12 wherein the first threshold value is more than 100% of an operating pressure rating for the mud motor.

14. The system according to claim 13 wherein the first threshold value is more than 120% of the operating pressure rating for the mud motor.

15. The system according to claim 14, further comprising:

determining, by the system, that the received differential pressure value exceeds a second threshold value within a second predetermined time period, wherein the second threshold value is based on the operating pressure rating for the mud motor; and responsive to the determining, providing an indication of a stall when the received differential pressure value exceeds the second threshold value within the second predetermined time period, wherein the second threshold value is more than 130% of the operating pressure rating for the mud motor.

16. A stall recovery system, the system comprising:

a processor connected to one or more control systems of a drilling rig enabled to drill a borehole;

a memory connected to the processor, wherein the memory comprises instructions for performing the following:

receiving an indication of a stall condition from a stall indicator system, the stall indicator system determining the stall condition by at least determining that (i) a differential pressure value is at or above a first threshold value and (ii) remains at or above the first threshold value for a minimum of a first predetermined time period; and responsive to the indication of a stall condition, controlling a mud pump to cease pumping drilling mud into the borehole; and controlling a release of pressure in the drilling mud.

17. The stall recovery system according to claim 16, wherein the instructions for controlling the release of pressure in the drilling mud further comprise instructions for controlling a valve in a drilling mud system to allow bleed off of the pressure in the drilling mud.

18. The stall recovery system according to claim 16, wherein the instructions for controlling the release of pressure in the drilling mud further comprise instructions for controlling at least one of:

a valve in a drilling mud system to allow bleed off of the pressure in the drilling mud, and a diaphragm-type pulsation dampener comprising hydraulic oil and a control valve, wherein the diaphragm-type pulsation dampener is in fluid communication with a standpipe via the control valve.

19. The stall recovery system according to claim 18, wherein the valve comprises a choke valve.

20. A stall recovery system, the system comprising:

a processor connected to one or more control systems of a drilling rig enabled to drill a borehole; and a memory connected to the processor, wherein the memory comprises instructions for performing the following:

receiving an indication of a stall condition during drilling of the borehole from a stall indicator system, the stall indicator system determining the stall condition by at least determining that (i) a differential pressure value is at or above a first threshold value and (ii) remains at or above the first threshold value for a minimum of a first predetermined time period;

determining a mode of drilling at a time of the indication of the stall condition, wherein the mode of drilling comprises at least one of slide drilling and rotary drilling;

responsive to the indication of a stall condition, controlling a mud pump to cease pumping drilling mud into the borehole;

controlling release of pressure in the drilling mud; and controlling resumption of drilling by the drilling rig in the mode of drilling at the time of the indication of the stall condition.

21. The stall recovery system according to claim 20, further comprising instructions for controlling a cessation of drilling, wherein the instructions for controlling the cessation of drilling comprise a first set of instructions for a cessation of slide drilling and a second set of instructions for a cessation of rotary drilling.

22. The stall recovery system according to claim 21, further comprising instructions for selecting between the first set of instructions and the second set of instructions responsive to the determining of the mode of drilling at the time of the stall condition.

23. The stall recovery system according to claim 22, wherein the instructions for controlling a resumption of drilling further comprise a third set of instructions for a resumption of slide drilling and a fourth set of instructions for a resumption of rotary drilling.

24. The stall recovery system according to claim 23, further comprising instructions for selecting between the third set of instructions and the fourth set of instructions responsive to the determining of the mode of drilling at the time of the stall condition.

25. The stall recovery system according to claim 24, further comprising instructions for determining if a stall condition of a mud motor occurs while drilling and providing an indication thereof, wherein the indication comprises at least one of an electric signal, a visual alert to an operator, an audible alert to an operator, an email, and a text message.

26. The stall recovery system according to claim 25, wherein the instructions for determining if a stall condition occurs comprise instructions for receiving a plurality of differential pressure values associated with a drilling mud differential pressure during drilling, comparing the plurality of differential pressure values to one or more thresholds including a first threshold, determining whether a differential pressure value exceeds the first threshold, and, responsive to determining a differential pressure value exceeds the first threshold, generating an indication of a stall condition.

27. The stall recovery system according to claim 26, wherein at least one threshold is associated with a pressure rating for the mud motor.

28. The stall recovery system according to claim 27, wherein the one or more thresholds comprise a plurality of thresholds.

29. The stall recovery system according to claim 28, wherein at least one of the one or more thresholds is associated with a drilling parameter comprising at least one of ROP and WOB.

30. The stall recovery system according to claim 26, wherein the instructions for determining whether a differential pressure value exceeds the first threshold comprises determining whether the differential pressure value exceeds the first threshold for at least a first time threshold.

31. A method for detecting a stall of a mud motor during drilling, the method comprising:

providing a drilling mud to a mud motor from a drilling mud system during drilling of a wellbore to a drill bit powered by the mud motor;

providing a plurality of differential pressure values of the drilling mud to a stall detection system;

determining, by the stall detection system, a differential pressure value is at or above a first threshold value for a minimum of a first predetermined time period or if the differential pressure value meets a second threshold value within a second predetermined time period, wherein the first threshold value and the second threshold value are based on a percentage value above 100% of a continuous operating pressure rating for the mud motor; and responsive to the determining, providing an indication of a stall when the differential pressure value is at or above the first threshold value for a minimum of the first predetermined time period, or if the differential pressure value meets the second threshold value within the second predetermined time period, wherein the second threshold value is more than 130% of the continuous operating pressure rating for the mud motor and the second predetermined time period is less than the first predetermined time period.

32. The method according to claim 31, further comprising the step of providing, by the stall detection system, a signal indicating a mud motor stall to at least one control system for at least one item of equipment of a drilling rig that is drilling the wellbore.

33. The method according to claim 32, wherein the at least one item of equipment is at least one of a top drive, a drilling mud pump, a hoist, and a display for an operator.

* * * * *